US012435486B2

(12) United States Patent
Isogai et al.

(10) Patent No.: US 12,435,486 B2
(45) Date of Patent: Oct. 7, 2025

(54) DEEP FOUNDATION EXCAVATOR

(71) Applicant: HITACHI CONSTRUCTION MACHINERY CO., LTD., Tokyo (JP)

(72) Inventors: Kasumi Isogai, Omitama (JP); Akira Inamoto, Kashiwa (JP); Minoru Itou, Ushiku (JP); Seiji Seki, Omitama (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 896 days.

(21) Appl. No.: 17/633,979

(22) PCT Filed: Mar. 9, 2021

(86) PCT No.: PCT/JP2021/009328
§ 371 (c)(1),
(2) Date: Feb. 9, 2022

(87) PCT Pub. No.: WO2021/199965
PCT Pub. Date: Oct. 7, 2021

(65) Prior Publication Data

US 2022/0267984 A1 Aug. 25, 2022

(30) Foreign Application Priority Data

Mar. 31, 2020 (JP) ..... 2020-063331
Mar. 31, 2020 (JP) ..... 2020-063338

(51) Int. Cl.
*E02F 3/47* (2006.01)
*E02F 3/413* (2006.01)

(52) U.S. Cl.
CPC ..... *E02F 3/47* (2013.01); *E02F 3/4135* (2013.01)

(58) Field of Classification Search
CPC . E02F 3/47; E02F 3/4135; E02F 3/413; E02F 3/475; E02F 3/46; E02F 3/306; E02F 3/44
See application file for complete search history.

(56) References Cited

U.S. PATENT DOCUMENTS 3,157,288 A * 11/1964 Wieger ..... E02F 3/47 212/243
3,303,590 A * 2/1967 Grospas ..... E02F 3/47 37/461
2022/0267984 A1* 8/2022 Isogai ..... E02F 9/2296

FOREIGN PATENT DOCUMENTS

CN 104234100 A 12/2014
CN 210193255 U 3/2020
(Continued)

OTHER PUBLICATIONS

Chinese Office Action received in corresponding Chinese Application No. 202180004920.9 dated Nov. 1, 2022.
(Continued)

*Primary Examiner* — Christopher J Sebesta
*Assistant Examiner* — Blake E Scoville
(74) *Attorney, Agent, or Firm* — Mattingly & Malur, PC

(57) ABSTRACT

A bucket raising/lowering and opening/closing device (11) of a deep foundation excavator (1) includes a raising/lowering cylinder (12), a first raising/lowering sheave (14) and a first opening/closing sheave (15) that move in an expansion/contraction direction of the raising/lowering cylinder (12), a second raising/lowering sheave (17), a second opening/closing sheave (20), an opening/closing cylinder (18) that moves the second opening/closing sheave (20) to be closer to and to be separated from the first opening/closing sheave (15), a raising/lowering rope (24) that is wound around the first raising/lowering sheave (14) and the second raising/lowering sheave (17), and an opening/closing
(Continued)

rope (25) that is wound around the first opening/closing sheave (15) and the second opening/closing sheave (20). In addition, provided are a slack adjustment cylinder (26) that expands and contracts to adjust the slack of the opening/closing rope (25), and a slack adjustment sheave (28) that moves in a direction of being closer to and being separated from the second opening/closing sheave (20) in response to an expansion/contraction movement of the slack adjustment cylinder (26).

5 Claims, 13 Drawing Sheets

(56) References Cited

FOREIGN PATENT DOCUMENTS

| | | | | | |
|---|---|---|---|---|---|
| DE | 2929463 | A | * | 2/1980 | ..... B66C 3/125 |
| DE | 29917595 | U1 | * | 11/2000 | ..... E02F 3/4135 |
| JP | 52-108602 | A | | 9/1977 | |
| JP | 52-131602 | A | | 11/1977 | |
| JP | S5736373 | B2 | * | 11/1977 | |
| JP | 56-159434 | A | | 12/1981 | |
| JP | 57-36373 | B2 | | 8/1982 | |
| JP | 58-176157 | U | | 11/1983 | |
| JP | 2003147800 | A | * | 5/2003 | ..... E02F 3/60 |

OTHER PUBLICATIONS

International Search Report of PCT/JP2021/009328 dated Apr. 20, 2021.

* cited by examiner

DEEP FOUNDATION EXCAVATOR

TECHNICAL FIELD

The present invention relates to deep foundation excavators to be used suitably for excavating a vertical shaft.

BACKGROUND ART

These days an inverted construction method for simultaneously constructing an above-ground part and an underground part has been used in a construction site of a tall building to be capable of stably shortening a construction period and carrying out an underground work even in a soft ground. A deep foundation excavator for excavating a vertical shaft is used in a site where this inverted construction method is executed.

The deep foundation excavator is provided with an automotive vehicle body and a working mechanism disposed in the vehicle body. This working mechanism is provided with a boom disposed in the vehicle body, an arm disposed in a tip end of the boom, a bucket raising/lowering device disposed in the arm and a clamshell bucket. The clamshell bucket is disposed to be capable of raising and lowering to the arm, and the vertical shaft is excavated by a raising/lowering movement and an opening/closing movement of the bucket raising/lowering device.

A device, which is provided with a raising/lowering cylinder for raising and lowering a clamshell bucket and an opening/closing cylinder for opening and closing the clamshell bucket, is proposed as a bucket raising/lowering device of this kind (Patent Document 1). The raising/lowering cylinder changes an interval between a movable sheave and a fixed sheave to wind off or wind up a raising/lowering rope to raise or lower the clamshell bucket. The opening/closing cylinder changes an interval between a movable sheave and a fixed sheave to wind off or wind up an opening/closing rope to open or close the clamshell bucket. The bucket raising/lowering device according to Patent Document 1 is configured so that by detecting the landing of the clamshell bucket on the ground, the lowering of the bucket by the raising/lowering cylinder is stopped, which prevents the raising/lowering rope from leaving from the sheave due to the slacking of the raising/lowering rope.

However, in the bucket raising/lowering device according to Patent Document 1 the lowering of the bucket is stopped when the clamshell bucket is landed on the ground. Therefore, the clamshell bucket is halted in a position of being landed on the ground and cannot get into under the ground by its own weight. As a result, even when the clamshell bucket is closed by the opening/closing cylinder, there occurs a problem that the bucket cannot shovel a lot of sand and earth.

On the other hand, a device is proposed as another bucket raising/lowering device according to the conventional technology, which is configured so that a drum, around which a raising/lowering rope and an opening/closing rope are wound, is disposed in a boom. This drum is switched to three forms of the raising and the lowering of the clamshell bucket, and the lowering by its own weight (free dropping) (Patent Document 2). In the bucket raising/lowering device according to Patent Document 2, a lower end of a swing link is attached to an arm attached on the boom. The opening/closing rope for connection between the drum and the clamshell bucket is wound around a sheave disposed in an upper end of the swing link. The bucket raising/lowering device is configured so that the swing link is caused to swing by expanding and contracting a cylinder connected to the swing link to open and close the clamshell bucket.

PRIOR ART DOCUMENT

Patent Document

Patent Document 1: Japanese Patent Laid-Open No. 2003-147800

Patent Document 2: Japanese Patent Publication No. 57-36373

SUMMARY OF THE INVENTION

The bucket raising/lowering device according to Patent Document 2 enables the clamshell bucket to get into under the ground by its own weight by making the drum in the form of free dropping. The clamshell bucket is closed by swinging the swing link in a state where the clamshell bucket is getting into under the ground. As a result, the bucket raising/lowering device can excavate a lot of sand and earth by an excavating movement one time to enhance an excavating efficiency.

However, the bucket raising/lowering device according to Patent Document 2 needs to cause the swing link mounted on the arm to swing for opening and closing the clamshell bucket. Therefore, a height of a vehicle body including a range in which the swing link swings at the excavating work becomes large, posing a problem of being incapable of applying this device to a working site having a height limitation, such as a site of executing an inverted construction method.

An object of the present invention is to provide a deep foundation excavator that can enhance an excavating efficiency of sand and earth and suppress a height of a vehicle body at the excavating work.

An aspect of the present invention is provided with a deep foundation excavator comprising:

- an automotive vehicle body; and
- a working mechanism disposed in the vehicle body, wherein the working mechanism includes:
- a boom disposed in the vehicle body;
- an arm disposed in a tip end of the boom;
- a bucket raising/lowering and opening/closing device disposed in the arm; and
- a clamshell bucket that is disposed to be capable of raising and lowering to the arm and excavates a vertical shaft by a raising/lowering movement and an opening/closing movement of the bucket raising/lowering and opening/closing device, and
- the bucket raising/lowering and opening/closing device includes:
- a raising/lowering cylinder disposed in the arm;
- a first raising/lowering sheave and a first opening/closing sheave that are attached to one end side of the raising/lowering cylinder and move in an expansion/contraction direction of the raising/lowering cylinder;
- a second raising/lowering sheave that is disposed in the arm to be separated from the first raising/lowering sheave in the expansion/contraction direction of the raising/lowering cylinder;
- a second opening/closing sheave that is disposed in the arm to be separated from the first opening/closing sheave in the expansion/contraction direction of the raising/lowering cylinder;

an opening/closing cylinder that is disposed in the arm and moves the second opening/closing sheave to be closer to and to be separated from the first opening/closing sheave;

a raising/lowering rope having one end in a length direction attached to the arm, the other end attached to the clamshell bucket and an intermediate portion wound around the first raising/lowering sheave and the second raising/lowering sheave; and an opening/closing rope having one end in a length direction attached to the arm, the other end attached to the clamshell bucket and an intermediate portion wound around the first opening/closing sheave and the second opening/closing sheave, characterized in that:

the bucket raising/lowering and opening/closing device further includes:

a slack adjustment cylinder that is disposed in the arm and expands and contracts for adjusting the slack of the opening/closing rope; and a slack adjustment sheave around which an intermediate portion of the opening/closing rope is wound in a state of being attached on one end of the slack adjustment cylinder and that moves in a direction of being closer to and being separated from the second opening/closing sheave in response to an expansion/contraction movement of the slack adjustment cylinder.

According to the aspect of the present invention, the raising/lowering cylinder is further operated after landing the clamshell bucket on the ground by the operation of the raising/lowering cylinder, thus enabling the raising/lowering rope and the opening/closing rope to be slacked. In this state, the slack adjustment cylinder is operated to remove the slack of the opening/closing rope, and thereafter, the clamshell bucket can quickly be closed by operating the opening/closing cylinder. At this time, since the raising/lowering rope has the slack, the clamshell bucket can get into under the ground by its own weight. Accordingly, since the clamshell bucket can shovel a lot of sand and earth by closing the clamshell bucket, the excavating efficiency can be enhanced.

MODE FOR CARRYING OUT THE INVENTION

Hereinafter, a deep foundation excavator according to an embodiment of the present invention will be in detail explained referring to the accompanying drawings. First, FIG. 1 to FIG. 9 show a first embodiment of the present invention.

Figure 1:
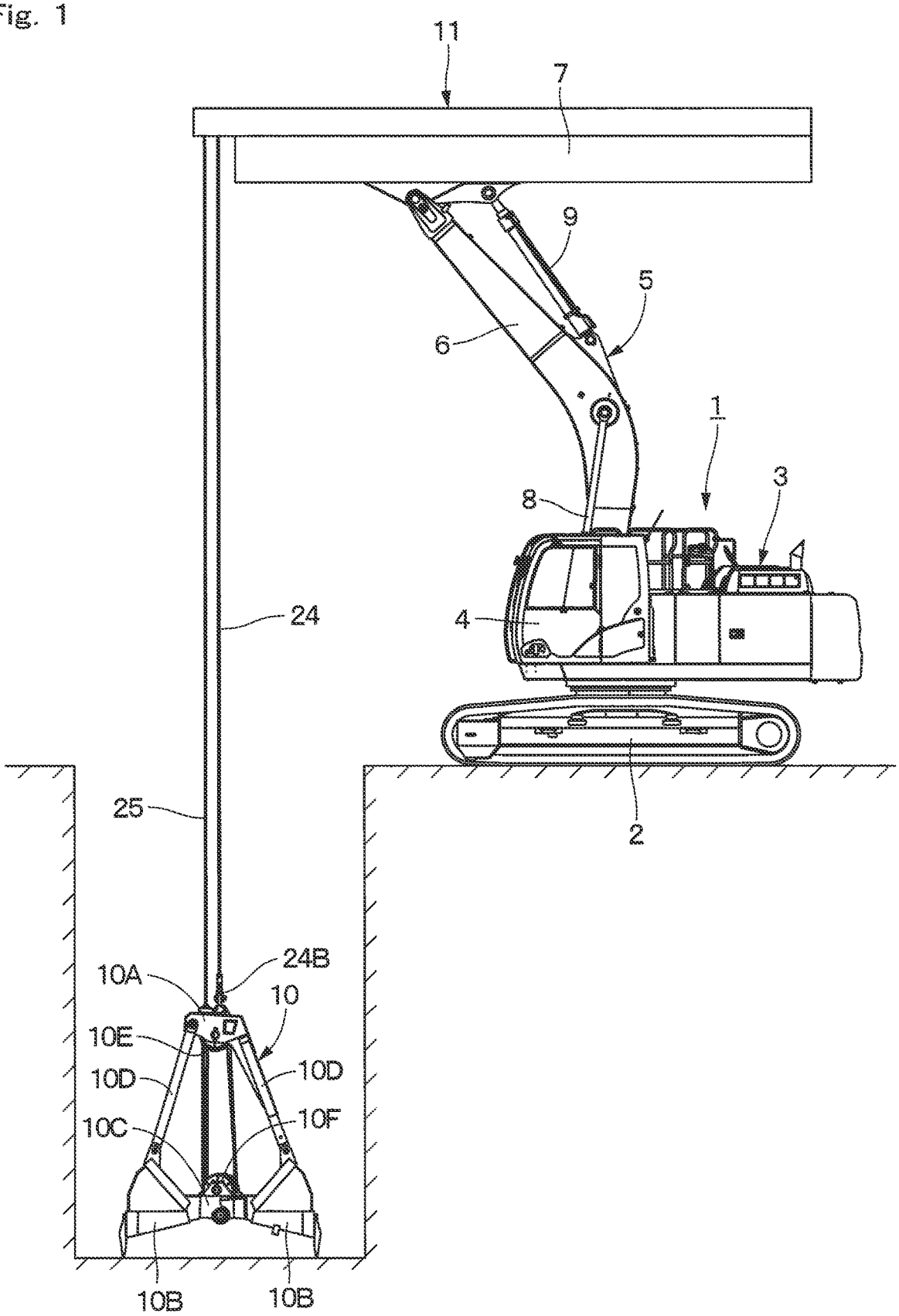
FIG. 1 is a left side view showing a deep foundation excavator according to a first embodiment of the present invention.

In FIG. 1, a deep foundation excavator 1 is manufactured on the basis of a crawler-type hydraulic excavator, for example. The deep foundation excavator 1 is configured of an automotive lower traveling structure 2 of a crawler type, an upper revolving structure 3 mounted on the lower traveling structure 2 to be capable of revolving thereto and an after-mentioned working mechanism 5 disposed on the upper revolving structure 3. The lower traveling structure 2 and the upper revolving structure 3 configure a vehicle body of the deep foundation excavator 1.

A cab 4 defining an operator's room is disposed in a left front side of the upper revolving structure 3. An operator gets in the cab 4 for operating the lower traveling structure 2, the working mechanism 5 and the like. An operator's seat (not shown) on which an operator sits is disposed in the cab 4, and a raising/lowering operation pedal 36, an opening/closing operation lever 39 and a slack operation pedal 42, which will be described later, and the like are arranged in the periphery of the operator's seat.

The working mechanism 5 is configured of a boom 6 attached on the upper revolving structure 3 to be capable of tilting and lifting thereto, an arm 7 disposed on a tip end of the boom 6 to be rotatable thereto, an after-mentioned bucket raising/lowering and opening/closing device 11 and a clamshell bucket 10. A boom cylinder 8 is disposed between the upper revolving structure 3 and the boom 6 to tilt and lift the boom 6 to the upper revolving structure 3. An arm cylinder 9 is disposed between the boom 6 and the arm 7 to rotate the arm 7 to the boom 6.

Figure 2:
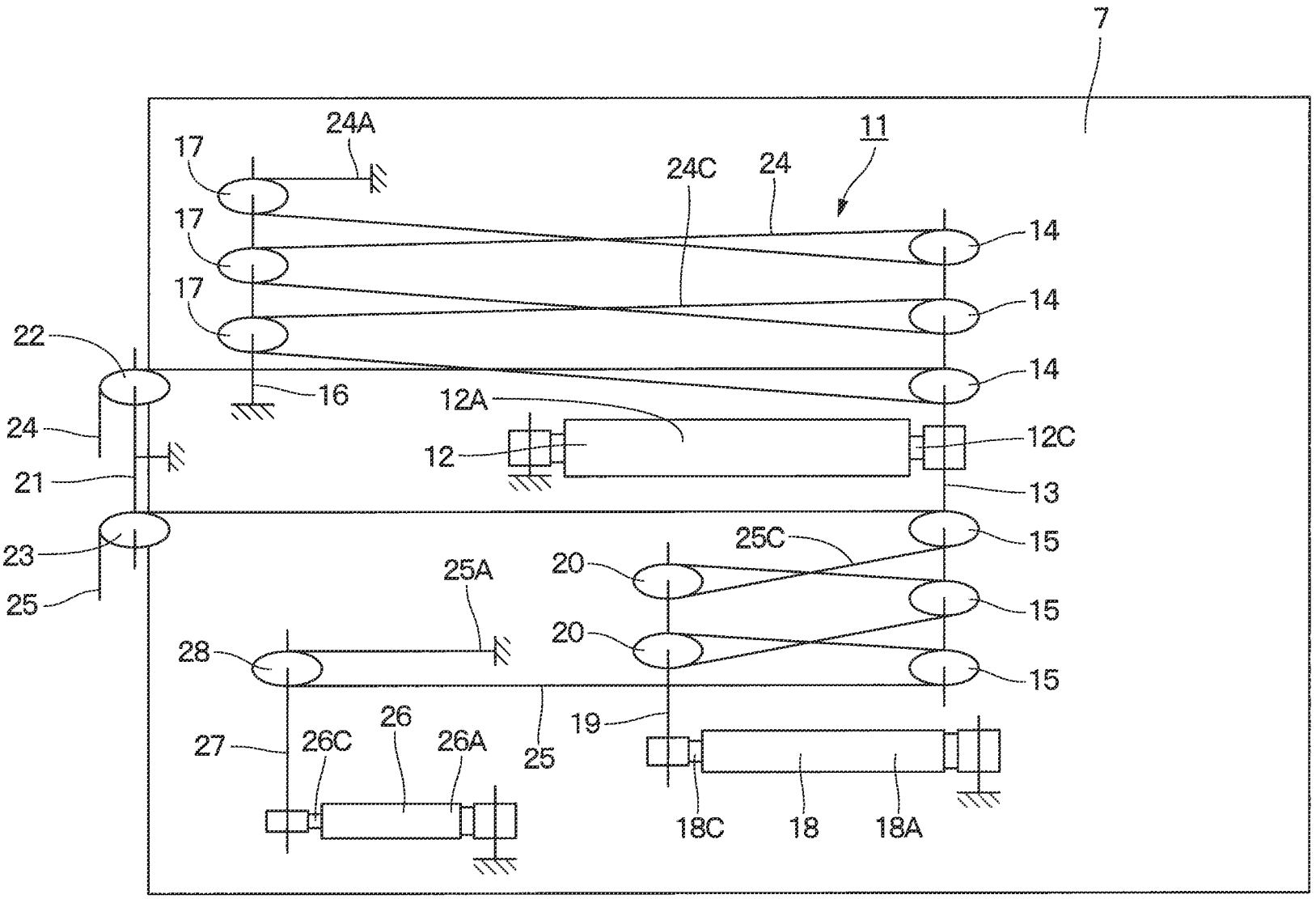
FIG. 2 is a configuration diagram schematically showing a bucket raising/lowering and opening/closing device.

The arm 7 is formed in a long square cylindrical body, for example. As shown in FIG. 2, the bucket raising/lowering and opening/closing device 11 is mounted on the arm 7. A raising/lowering guide sheave 22 and an opening/closing guide sheave 23 are arranged in a tip end portion of the arm 7. The raising/lowering guide sheave 22 guides an after-mentioned raising/lowering rope 24 downward and the opening/closing guide sheave 23 guides an after-mentioned opening/closing rope 25 downward.

The clamshell bucket 10 has a bucket support portion 10A, a pair of buckets 10B arranged under the bucket support portion 10A to be capable of opening and closing, a connection bracket 10C and a pair of opening/closing arms 10D. The pair of buckets 10B are rotatably connected to the connection bracket 10C. The pair of opening/closing arms 10D connect between the bucket support portion 10A and the pair of buckets 10B. An upper sheave 10E composed of a plurality of sheaves is disposed on the bucket support portion 10A. A lower sheave 10F composed of a plurality of sheaves is disposed on the connection bracket 10C to face the upper sheave 10E in an upper-lower direction.

The other end 24B of the raising/lowering rope 24 is attached on the bucket support portion 10A of the clamshell bucket 10. The opening/closing rope 25 is alternately wound around the upper sheave 10E and the lower sheave 10F of the clamshell bucket 10. The other end 25B of the opening/closing rope 25 is attached on the bucket support portion 10A of the clamshell bucket 10 (refer to FIG. 4).

The bucket raising/lowering and opening/closing device 11 is disposed on the arm 7. The bucket raising/lowering and opening/closing device 11 performs various kinds of movements including a raising/lowering movement and an opening/closing movement of the clamshell bucket 10. As shown in FIG. 2, the bucket raising/lowering and opening/closing device 11 is configured of a raising/lowering cylinder 12, a first raising/lowering sheave 14, a first opening/closing sheave 15, a second raising/lowering sheave 17, an opening/closing cylinder 18, a second opening/closing sheave 20, the raising/lowering rope 24, the opening/closing rope 25, a slack adjustment cylinder 26 and a slack adjustment sheave 28, which will be described later.

The raising/lowering cylinder 12 is disposed on the arm along a longitudinal direction of the arm 7. The raising/lowering cylinder 12 expands or contracts in response to a depressing operation of an after-mentioned raising/lowering operation pedal 36 to raise and lower the clamshell bucket 10. The raising/lowering cylinder 12 has a tube 12A a base end of which is attached on the arm 7, and a piston 12B and a rod 12C inserted into the tube 12A. The rod 12C has a base end attached to the piston 12B in the tube 12A and a tip end projecting from the tube 12A to be capable of expanding/contracting.

A first shaft member 13 is connected to a tip end of the rod 12C of the raising/lowering cylinder 12. The first shaft member 13 extends in an expansion/contraction of the raising/lowering cylinder 12, that is, in a lateral direction (width direction) intersecting with the longitudinal direction of the arm 7 to rotatably support the first raising/lowering sheave 14 and the first opening/closing sheave 15.

The first raising/lowering sheave 14 is attached via the first shaft member 13 to the tip end of the rod 12C as one end side of the raising/lowering cylinder 12. The first raising/lowering sheave 14 is composed of a plurality of sheaves (in FIG. 2, three sheaves are shown as an example) arranged in a state of overlapping in the lateral direction on the first shaft member 13, and is movable in the expansion/contraction direction of the raising/lowering cylinder 12 (in the longitudinal direction of the arm 7). The number of the sheave of the first raising/lowering sheave 14 is set in accordance with a vertical excavation depth as needed.

The first opening/closing sheave 15 is attached via the first shaft member 13 to the tip end of the rod 12C as one end side of the raising/lowering cylinder 12 together with the first raising/lowering sheave 14. The first opening/closing sheave 15 is arranged at the opposite side to the first raising/lowering sheave 14 across the raising/lowering cylinder 12, for example. The first opening/closing sheave 15 is composed of a plurality of sheaves (in FIG. 2, three sheaves are shown as an example) arranged in a state of overlapping in the lateral direction on the first shaft member 13, and is movable in the expansion/contraction direction of the raising/lowering cylinder 12. Accordingly, the first opening/closing sheave 15 composed of the plurality of sheaves and the first raising/lowering sheave 14 composed of the plurality of sheaves integrally move in the longitudinal direction of the arm 7 by the expansion/contraction movement of the raising/lowering cylinder 12.

A second shaft member 16 is connected to a tip end side of the arm 7 on which the raising/lowering guide sheave 22 and the opening/closing guide sheave 23 are arranged. The second shaft member 16 extends in a direction (in a lateral direction) intersecting with the expansion/contraction direction of the raising/lowering cylinder 12 to rotatably support the second raising/lowering sheave 17 composed of a plurality of sheaves.

The second raising/lowering sheave 17 is rotatably supported on the second shaft member 16 in a state of being separated from the first raising/lowering sheave 14 composed of the plurality of sheaves in the expansion/contraction direction of the raising/lowering cylinder 12. The second raising/lowering sheave 17 is composed of a plurality of sheaves (in FIG. 2, three sheaves are shown as an example) arranged in a state of overlapping in the lateral direction on the second shaft member 16, and fixed in the expansion/contraction direction of the raising/lowering cylinder 12 to the arm 7. Accordingly, the first raising/lowering sheave 14 moves to be closer to or to be separated from the second raising/lowering sheave 17 in response to the expansion/contraction movement of the raising/lowering cylinder 12.

The opening/closing cylinder 18 is disposed to extend in the longitudinal direction of the arm 7 to be in parallel to the raising/lowering cylinder 12. The opening/closing cylinder 18 expands or contracts in response to a tilting operation of an after-mentioned opening/closing operation lever 39 to open or close the clamshell bucket 10. The opening/closing cylinder 18 has a tube 18A a base end of which is attached on the arm 7, and a piston 18B and a rod 18C inserted into the tube 18A. The rod 18C has a base end attached to the piston 18B in the tube 18A and a tip end projecting from the tube 18A to be capable of expanding/contracting.

A third shaft member 19 is connected to a tip end of the rod 18C in the opening/closing cylinder 18. The third shaft member extends in the expansion/contraction direction of the raising/lowering cylinder 12, that is, in the lateral direction intersecting with the longitudinal direction of the arm 7 to rotatably support the second opening/closing sheave 20.

The second opening/closing sheave 20 is rotatably supported on the third shaft member 19 in a state of being separated from the first opening/closing sheave 15 composed of sheaves in the expansion/contraction direction of the raising/lowering cylinder 12. The second opening/closing sheave 20 is composed of a plurality of sheaves (in FIG. 2, two sheaves are shown as an example) arranged in a state of overlapping in the lateral direction on the third shaft member 19, and is movable in the expansion/contraction direction of the opening/closing cylinder (in the longitudinal direction of the arm 7). The opening/closing cylinder 18 moves the second opening/closing sheave 20 in the longitudinal direction of the arm 7 in response to the expansion/contraction movement to move the second opening/closing sheave 20 to be closer to or to be separated from the first opening/closing sheave 15.

A fourth shaft member 21 is disposed to a tip end portion of the arm 7. The fourth shaft member 21 extends in the expansion/contraction direction of the raising/lowering cylinder 12, that is, in the lateral direction intersecting with the longitudinal direction of the arm 7 to rotatably support the raising/lowering guide sheave 22 and the opening/closing guide sheave 23.

The raising/lowering guide sheave 22 and the opening/closing guide sheave 23 are arranged via the fourth shaft member 21 on the tip end portion of the arm 7. The raising/lowering guide sheave 22 and the opening/closing guide sheave 23 are rotatably supported on the fourth shaft member 21. The raising/lowering guide sheave 22 guides the after-mentioned raising/lowering rope 24 from the arm 7 (the bucket raising/lowering and opening/closing device 11) toward the clamshell bucket 10. On the other hand, the opening/closing guide sheave 23 guides the after-mentioned opening/closing rope 25 from the arm 7 toward the clamshell bucket 10.

The raising/lowering rope 24 is disposed between the arm 7 and the clamshell bucket 10, and supports the clamshell bucket 10 to be capable of raising/lowering the clamshell bucket 10. The raising/lowering rope 24 is composed of a wire rope, and one end 24A thereof in the length direction is attached to the arm 7. The other end 24B of the raising/lowering rope 24 in the length direction extends downward from the raising/lowering guide sheave 22 and is attached to the bucket support portion 10A of the clamshell bucket 10 (refer to FIG. 4). An intermediate portion 24C of the raising/lowering rope 24 is wound around the first raising/lowering sheave 14 composed of the plurality of sheaves and the second raising/lowering sheave 17 composed of the plurality of sheaves alternately.

The opening/closing rope 25 is disposed between the arm 7 and the clamshell bucket 10, and opens and closes the pair of buckets 10B of the clamshell bucket 10. The opening/closing rope 25 is composed of a wire rope, and one end 25A thereof in the length direction is attached to the arm 7. The other end 25B of the opening/closing rope 25 in the length direction extends downward from the opening/closing guide sheave 23 and is attached to the bucket support portion 10A of the clamshell bucket 10 (refer to FIG. 4). An intermediate portion 25C of the opening/closing rope 25 is wound around the first opening/closing sheave 15 composed of the plurality of sheaves and the second opening/closing sheave 20 composed of the plurality of sheaves alternately. In addition, the other end 25B-side of the opening/closing rope 25 is wound around the upper sheave 10E composed of the plurality of sheaves and the lower sheave 10F composed of the plurality of sheaves configuring the clamshell bucket 10 alternately.

Accordingly, the clamshell bucket 10 lowers when the first raising/lowering sheave 14 moves toward the second raising/lowering sheave 17 due to the contraction of the raising/lowering cylinder 12. In addition, the clamshell bucket 10 raises when the first raising/lowering sheave 14 moves to be separated from the second raising/lowering sheave 17 due to the expansion of the raising/lowering cylinder 12. In this case, by increasing the number of the sheave in each of the first raising/lowering sheave 14 and the second raising/lowering sheave 17 or changing a stroke of the raising/lowering cylinder 12, a lowering distance (maximum depth) of the clamshell bucket 10 can be set freely.

On the other hand, the clamshell bucket 10 opens when the second opening/closing sheave 20 moves toward the first opening/closing sheave 15 due to the contraction of the opening/closing cylinder 18. In addition, the clamshell bucket 10 closes when the second opening/closing sheave 20 moves to be separated from the first opening/closing sheave 15 due to the expansion of the opening/closing cylinder 18. In this case, by changing a stroke of the opening/closing cylinder 18, it is possible to respond to an opening/closing stroke of the clamshell bucket 10.

Here, a force (pulling-up force) acting on the opening/closing rope 25 from the opening/closing cylinder 18 at the time of closing the clamshell bucket 10 is set to be smaller than the weight of the clamshell bucket 10. As a result, when the clamshell bucket 10 is closed to shovel sand and earth, the force acting on the opening/closing rope 25 from the opening/closing cylinder 18 prevents the clamshell bucket 10 from lifting up. A torsional direction of the raising/lowering rope 24 and a torsional direction of the opening/closing rope 25 are set to be reverse to each other in a state of holding the clamshell bucket 10. This configuration suppresses the clamshell bucket 10 from causing rotation deflection at the raising/lowering, and it is possible to smoothly raise and lower the clamshell bucket 10 by the raising/lowering rope 24 and the opening/closing rope 25.

The slack adjustment cylinder 26 is disposed to extend in the longitudinal direction of the arm 7 to be in parallel to the raising/lowering cylinder 12. The slack adjustment cylinder 26 expands or contracts in response to a depression operation of the after-mentioned slack operation pedal 42 to adjust the tension of the opening/closing rope 25. The slack adjustment cylinder 26 has a tube 26A, a base end of which is attached to the arm 7, and a piston 26B and a rod 26C inserted into the tube 26A. The rod 26C has a base end attached to the piston 26B in the tube 26A and a tip end projecting from the tube 26A to be capable of expanding/contracting.

A fifth shaft member 27 is connected to a tip end of the rod 26C in the slack adjustment cylinder 26. The fifth shaft member 27 extends in the expansion/contraction direction of the raising/lowering cylinder 12, that is, in the lateral direction intersecting with the longitudinal direction of the arm 7 to rotatably support an after-mentioned slack adjustment sheave 28.

The slack adjustment sheave 28 is rotatably supported on the fifth shaft member 27 in a state of being separated from the second opening/closing sheave 20 in the expansion/contraction direction of the raising/lowering cylinder 12. The slack adjustment sheave 28, around which one end 25A-side of the opening/closing rope 25 is wound, is movable in the expansion/contraction direction of the slack adjustment cylinder 26 (in the longitudinal direction of the arm 7). Accordingly, the slack adjustment sheave 28 moves to be closer to or to be separated from the second opening/closing sheave 20 in response to the expansion/contraction movement of the slack adjustment cylinder 26. In a state where the clamshell bucket 10 is landed on the ground at the excavating work of the vertical shaft, the slack adjustment cylinder 26 is caused to expand. This expansion can separate the slack adjustment sheave 28 from the second opening/closing sheave 20 to remove the slack of the opening/closing rope 25.

Figure 3:
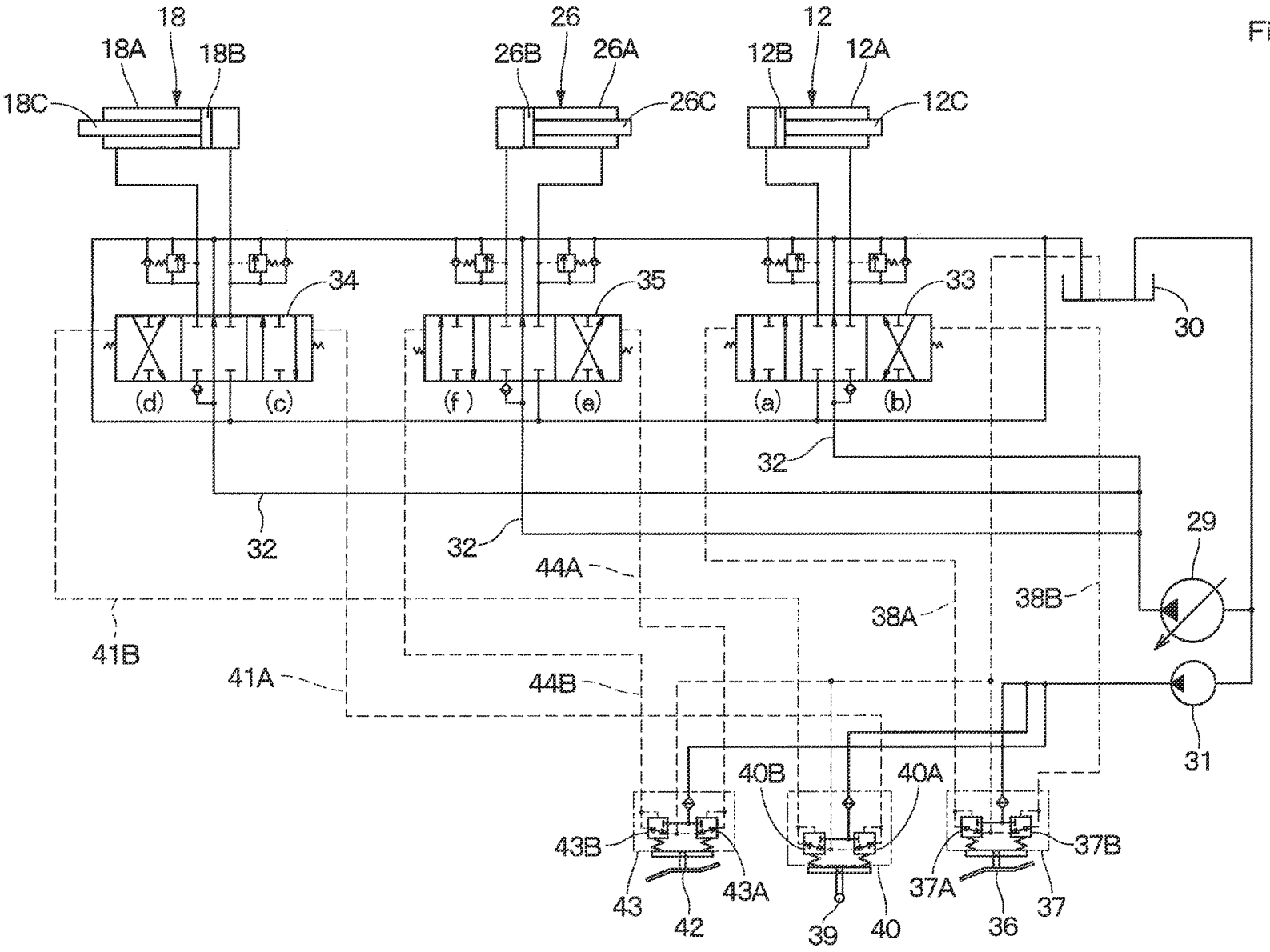
FIG. 3 is a hydraulic circuit diagram of the bucket raising/lowering and opening/closing device.

Next, an explanation will be made of a hydraulic circuit for driving the raising/lowering cylinder 12, the opening/closing cylinder 18 and the slack adjustment cylinder 26 configuring the bucket raising/lowering and opening/closing device 11 by referring to FIG. 3.

A hydraulic pump 29 configures a hydraulic source together with a tank 30. The hydraulic pump 29 is driven by a prime mover mounted on the deep foundation excavator 1. A pilot pump 31 is connected to the hydraulic pump 29, and the pilot pump 31 is driven together with hydraulic pump 29 by the prime mover. Hydraulic oil delivered from the hydraulic pump 29 is selectively supplied via a center bypass-type main line 32 to the raising/lowering cylinder 12, the opening/closing cylinder 18 and the slack adjustment cylinder 26.

A raising/lowering switching valve 33 is disposed between the hydraulic pump 29 and the raising/lowering cylinder 12 in the main line 32. In addition, an opening/closing switching valve 34 is disposed between the hydraulic pump 29 and the opening/closing cylinder 18 in the main line 32. In addition, the raising/lowering switching valve 33 and the opening/closing switching valve 34 each is configured of a hydraulic pilot-type directional control valve of a six-port and three-position, for example.

When the raising/lowering switching valve 33 is switched from a neutral position to a switch position (a), the hydraulic oil delivered from the hydraulic pump 29 is supplied to a rod-side oil chamber in the raising/lowering cylinder 12 to contract the raising/lowering cylinder 12. On the other hand, when the raising/lowering switching valve 33 is switched from the neutral position to a switch position (b), the hydraulic oil delivered from the hydraulic pump 29 is supplied to a bottom-side oil chamber in the raising/lowering cylinder 12 to expand the raising/lowering cylinder 12.

When the opening/closing switching valve 34 is switched from a neutral position to a switch position (c), the hydraulic oil delivered from the hydraulic pump 29 is supplied to a rod-side oil chamber in the opening/closing cylinder 18 to contract the opening/closing cylinder 18. On the other hand, when the opening/closing switching valve 34 is switched from the neutral position to a switch position (d), the hydraulic oil delivered from the hydraulic pump 29 is supplied to a bottom-side oil chamber in the opening/closing cylinder 18 to expand the opening/closing cylinder 18.

A slack adjustment switching valve 35 is disposed between the hydraulic pump 29 and the slack adjustment cylinder 26 in the main line 32. In addition, the slack adjustment switching valve 35 is configured of a hydraulic pilot-type directional control valve of a six-port and three-position, for example. When the slack adjustment switching valve 35 is switched from a neutral position to a switch position (e), the hydraulic oil delivered from the hydraulic pump 29 is supplied to a rod-side oil chamber in the slack adjustment cylinder 26 to contract the slack adjustment cylinder 26. On the other hand, when the slack adjustment switching valve 35 is switched from the neutral position to a switch position (f), the hydraulic oil delivered from the hydraulic pump 29 is supplied to a bottom-side oil chamber in the slack adjustment cylinder 26 to expand the slack adjustment cylinder 26.

The raising/lowering operation pedal 36, the opening/closing operation lever 39 and the slack operation pedal 42 are arranged in the cab 4 of the deep foundation excavator 1. The raising/lowering operation pedal 36 is attached to a pilot operation valve 37 of a pressure reduction-valve type having a pair of pressure reduction valve portions 37A, 37B, and is operated to be depressed to a contraction side or an expansion side. When the raising/lowering operation pedal 36 is depressed to the contraction side, a pilot pressure delivered from the pilot pump 31 is supplied via a pilot line 38A to the raising/lowering switching valve 33. Thereby, the raising/lowering switching valve 33 is switched to the switch position (a) to contract the raising/lowering cylinder 12. On the other hand, when the raising/lowering operation pedal 36 is depressed to the expansion side, the pilot pressure delivered from the pilot pump 31 is supplied via a pilot line 38B to the raising/lowering switching valve 33. Thereby, the raising/lowering switching valve 33 is switched to the switch position (b) to expand the raising/lowering cylinder 12.

The opening/closing operation lever 39 is attached to a pilot operation valve 40 of a pressure reduction-valve type having a pair of pressure reduction valve portions 40A, 40B. The opening/closing operation lever 39 is operated to be tilted to a contraction side or an expansion side by an operator. For example, when the opening/closing operation lever 39 is tilted to the contraction side, the pilot pressure is supplied via a pilot line 41A to the opening/closing switching valve 34. Thereby, the opening/closing switching valve 34 is switched to the switch position (c) to contract the opening/closing cylinder 18. On the other hand, when the opening/closing operation lever 39 is tilted to the expansion side, the pilot pressure is supplied via a pilot line 41B to the opening/closing switching valve 34. Thereby, the opening/closing switching valve 34 is switched to the switch position (d) to expand the opening/closing cylinder 18.

The slack operation pedal 42 is attached to a pilot operation valve 43 of a pressure reduction-valve type having a pair of pressure reduction valve portions 43A, 43B. The slack operation pedal 42 is operated to be depressed to a contraction side or an expansion side by an operator. For example, when the slack operation pedal 42 is depressed to the contraction side, the pilot pressure is supplied via a pilot line 44A to the slack adjustment switching valve 35. Thereby, the slack adjustment switching valve 35 is switched to the switch position (e) to contract the slack adjustment cylinder 26. On the other hand, when the slack operation pedal 42 is depressed to the expansion side, the pilot pressure is supplied via a pilot line 44B to the slack adjustment switching valve 35. Thereby, the slack adjustment switching valve 35 is switched to a switch position (f) to expand the slack adjustment cylinder 26.

In this way, the raising/lowering cylinder 12, the opening/closing cylinder 18 and the slack adjustment cylinder 26 are independently operated by the raising/lowering operation pedal 36, the opening/closing operation lever 39 and the slack operation pedal 42 respectively.

The deep foundation excavator 1 according to the present embodiment has the configuration as described above, and hereinafter, an explanation will be made of the work for excavating the vertical shaft using the deep foundation excavator 1.

An operator getting in the cab 4 arranges the clamshell bucket 10 over the ground for excavating the vertical shaft in a state of being closed. In this state, the operator depresses the raising/lowering operation pedal 36 to the contraction side. Thereby, the pilot pressure is supplied via the pilot line 38A to the raising/lowering switching valve 33 to switch the raising/lowering switching valve 33 to the switch position (a). Thereby, the raising/lowering cylinder 12 is contracted, the first raising/lowering sheave 14 moves toward the second raising/lowering sheave 17 and the first opening/closing sheave 15 moves toward the second opening/closing sheave 20. As a result, the raising/lowering rope 24 and the opening/closing rope 25 are sent out from the arm 7 and the clamshell bucket 10 lowers.

Figure 4:
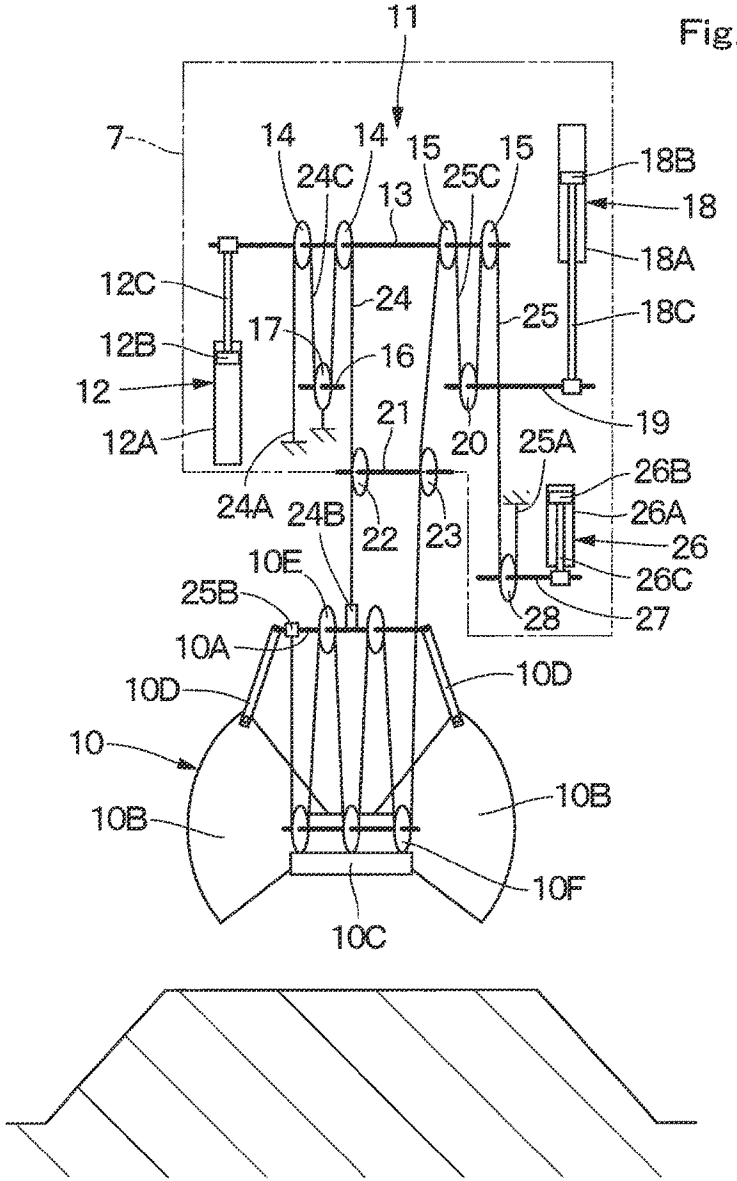
FIG. 4 is a movement explanation diagram schematically showing a movement of the bucket raising/lowering and opening/closing device when a clamshell bucket lowers.

When the clamshell bucket 10 lowers and reaches a position several meters (for example, two to three meters) from the ground, an operator stops the depression operation of the raising/lowering operation pedal 36 to once stop a lowering movement of the clamshell bucket 10. In addition, the operator tilts the opening/closing operation lever 39 to the contraction side. Thereby, the pilot pressure is supplied via the pilot line 41A to the opening/closing switching valve 34 to switch the opening/closing switching valve 34 to the switch position (c). Accordingly, the opening/closing cylinder 18 is contracted and the second opening/closing sheave 20 moves toward the first opening/closing sheave 15. As a result, the opening/closing rope 25 is sent out from the arm 7 and, as shown in FIG. 4, the pair of buckets 10B of the clamshell bucket 10 are fully opened.

Figure 5:
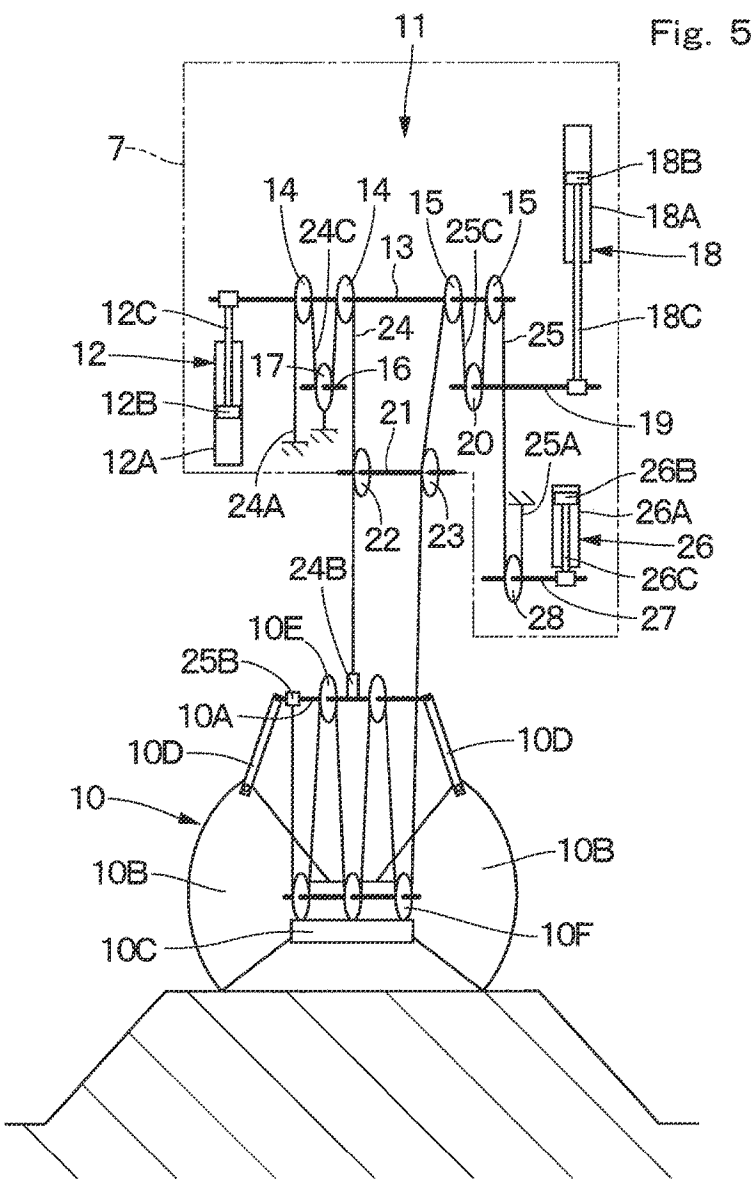
FIG. 5 is a movement explanation diagram schematically showing a movement of the bucket raising/lowering and opening/closing device when the clamshell bucket is landed on the ground.

In this way, after the clamshell bucket 10 is fully opened, the operator stops the operation of the opening/closing operation lever 39 and again depresses the raising/lowering operation pedal 36 to the contraction side. As a result, the fully opened clamshell bucket 10 lowers, and as shown in FIG. 5, the lower ends of the pair of buckets 10B are landed on the ground.

Figure 6:
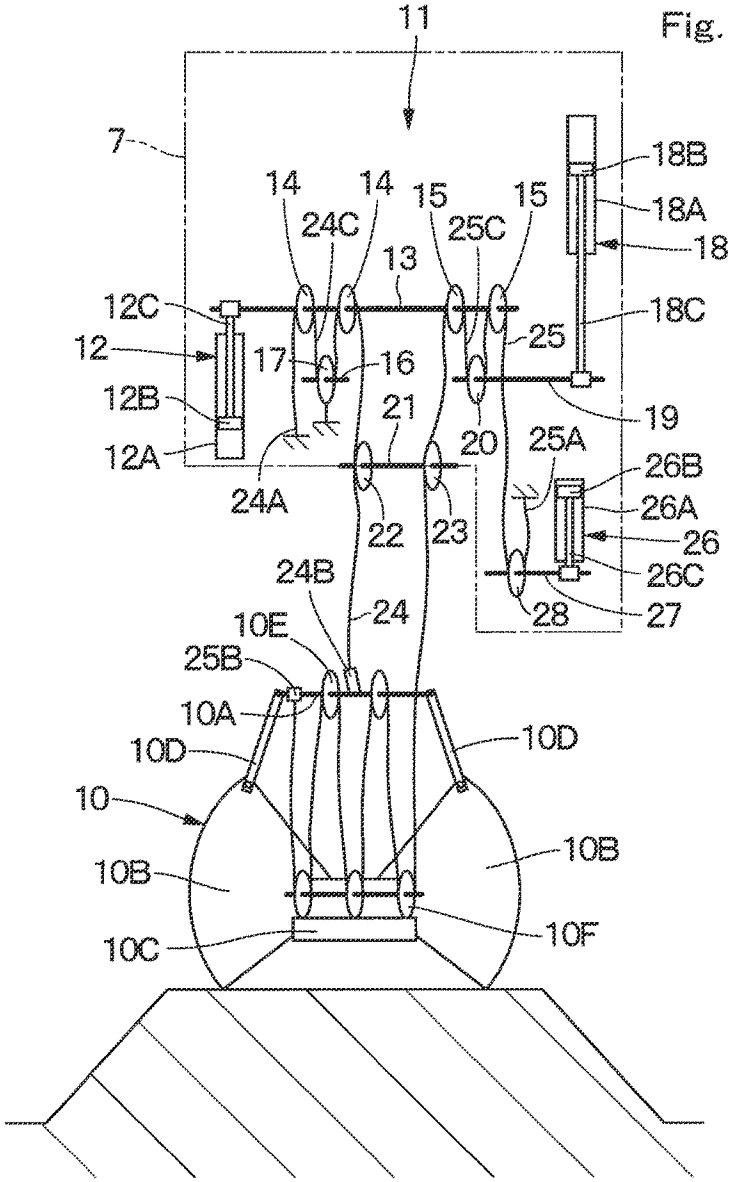
FIG. 6 is a movement explanation diagram schematically showing a state where a raising/lowering rope and an opening/closing rope are slacked after the clamshell bucket is landed.

After the lower end of the clamshell bucket 10 is landed on the ground, the operator continues to perform the depression operation of the raising/lowering operation pedal 36 to the contraction side. Thereby, while the clamshell bucket 10 is held in the landed position, the raising/lowering rope 24 and the opening/closing rope 25 are further sent out. Therefore, as shown in FIG. 6, the raising/lowering rope 24 and the opening/closing rope 25 start to be slacked. The clamshell bucket 10 gets into under the ground from the ground to shovel a lot of sand and earth. Therefore, by slacking the raising/lowering rope 24 and the opening/closing rope 25 after the lower end of the clamshell bucket 10 is landed on the ground, it is possible to cause the clamshell bucket 10 to get into under the ground in accordance with this slack amount.

Figure 7:
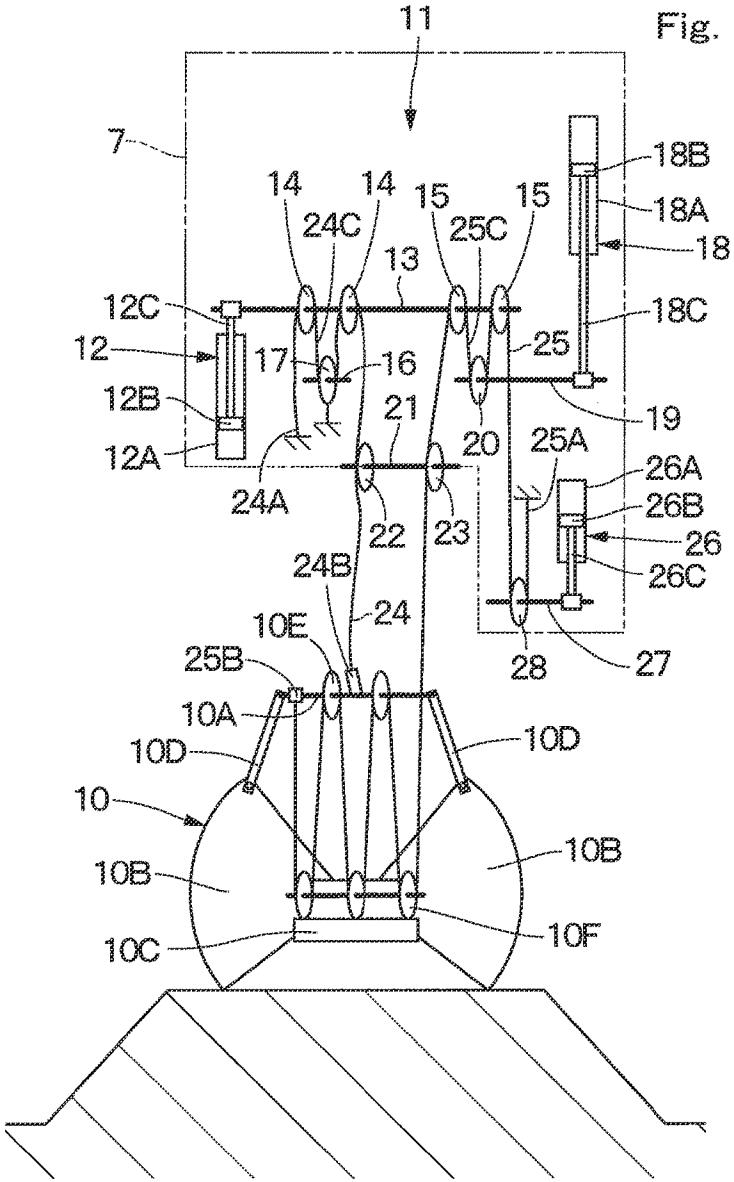
FIG. 7 is a movement explanation diagram schematically showing a state where the slack of the opening/closing rope is removed before closing the clamshell bucket.

Next, the operator depresses the slack operation pedal 42 to the expansion side before closing the clamshell bucket 10. Thereby, the pilot pressure is supplied via the pilot line 44B to the slack adjustment switching valve 35 to switch the slack adjustment switching valve 35 to the switch position (f). Accordingly, as shown in FIG. 7, the slack adjustment cylinder 26 is expanded and the slack adjustment sheave 28 moves to be separated from the second opening/closing sheave 20. As a result, while the raising/lowering rope 24 is slacked, only the slack of the opening/closing rope 25 is removed.

Figure 8:
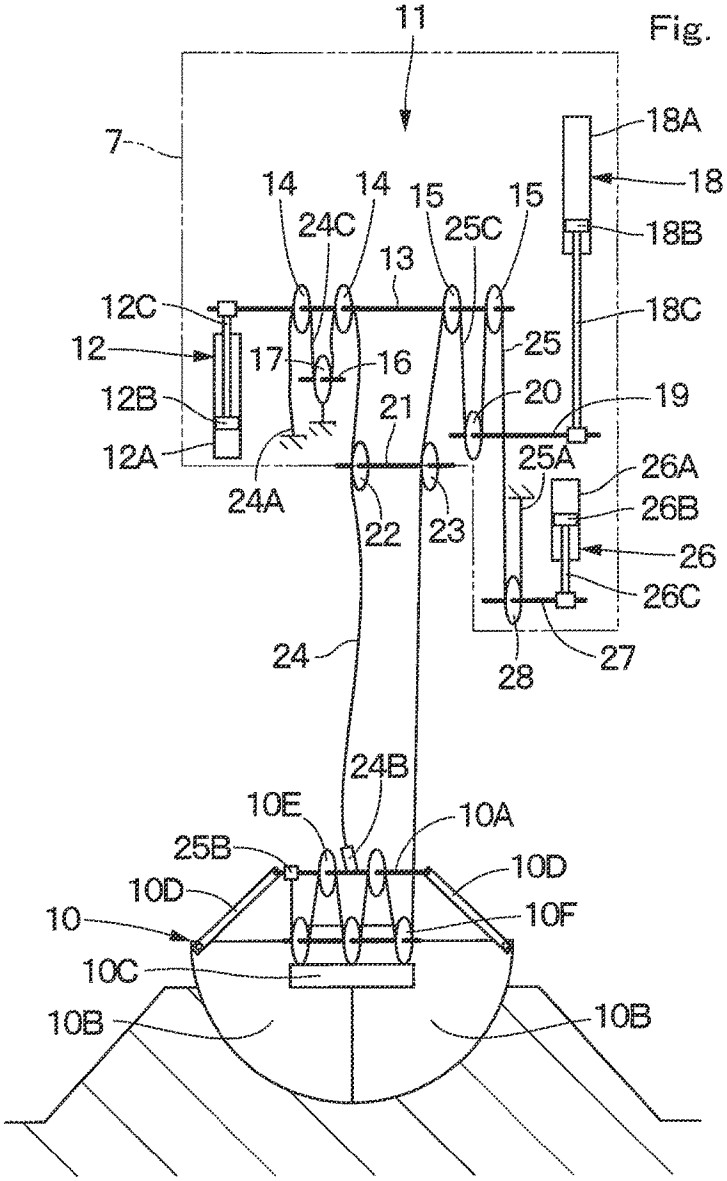
FIG. 8 is a movement explanation diagram schematically showing a movement of the bucket raising/lowering and opening/closing device when the clamshell bucket is closed to excavate sand and earth.

Next, the operator tilts the opening/closing operation lever 39 to the expansion side. Thereby, the pilot pressure is supplied via the pilot line 41B to the opening/closing switching valve 34 to switch the opening/closing switching valve 34 to the switch position (d). Accordingly, as shown in FIG. 8, the opening/closing cylinder 18 is expanded and the second opening/closing sheave 20 moves to be separated from the first opening/closing sheave 15. As a result, the opening/closing rope 25 is pulled up. As a result, the clamshell bucket 10 will be closed while getting into under the ground by its own weight, and can shovel a lot of sand and earth. In this case, at a stage prior to the closing of the clamshell bucket 10, while the raising/lowering rope 24 is slacked, only the slack of the opening/closing rope 25 is removed. Thereby, at the same time the opening/closing cylinder 18 expands, the clamshell bucket 10 can be closed to quickly excavate sand and earth.

Here, a force (pulling-up force) acting on the opening/closing rope 25 from the opening/closing cylinder 18 at the time of closing the clamshell bucket 10 is set to be smaller than the weight of the clamshell bucket 10. As a result, after the clamshell bucket 10 is closed to excavate sand and earth, the force acting on the opening/closing rope 25 from the opening/closing cylinder 18 prevents the clamshell bucket 10 from lifting up. At this time, since the raising/lowering rope 24 is in advance slacked so that the clamshell bucket 10 can get into under the ground sufficiently, the slack remains in the raising/lowering rope 24 to some degrees in a state where the clamshell bucket 10 is closed under the ground.

After the clamshell bucket 10 is closed to shovel sand and earth, the operator depresses the raising/lowering operation pedal 36 to the expansion side and depresses the slack operation pedal 42 to the contraction side. The pilot pressure is supplied via the pilot line 38B to the raising/lowering switching valve 33 to switch the raising/lowering switching valve 33 to the switch position (b) in response to the operation of the raising/lowering operation pedal 36. In addition, the pilot pressure is supplied via the pilot line 44A to the slack adjustment switching valve 35 to switch the slack adjustment switching valve 35 to the switch position (e) in response to the operation of the slack operation pedal 42.

Figure 9:
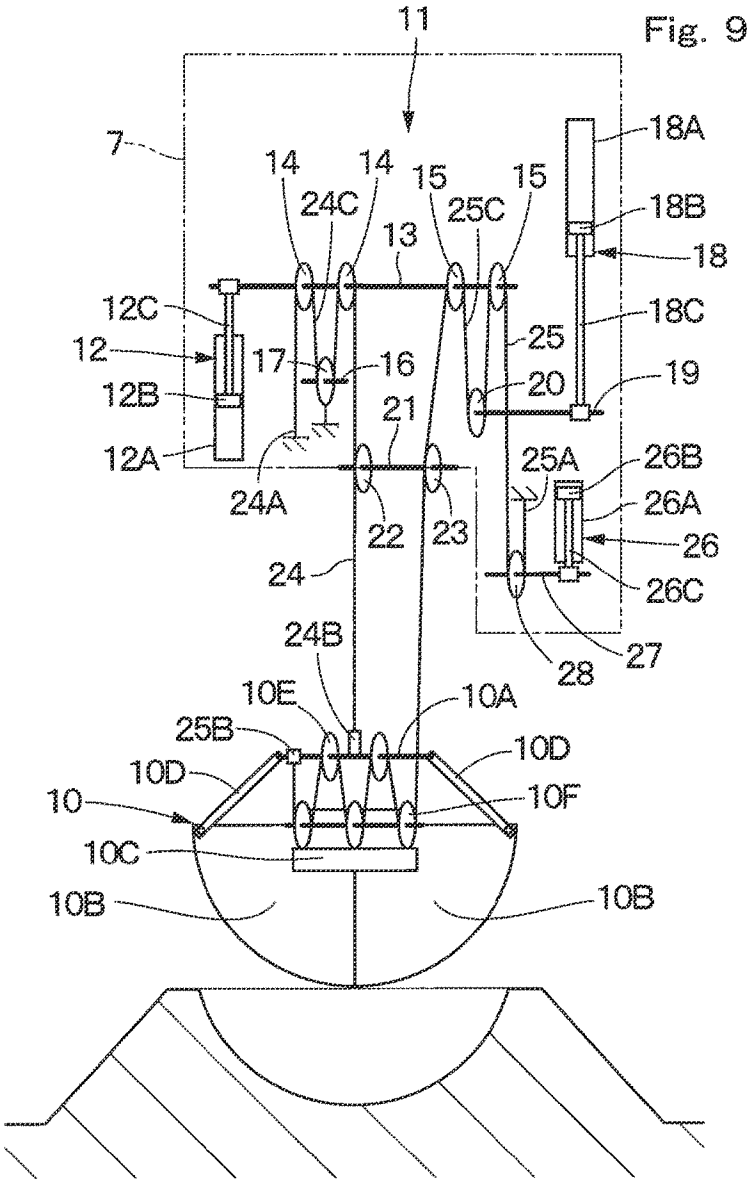
FIG. 9 is a movement explanation diagram schematically showing a movement of the bucket raising/lowering and opening/closing device when the clamshell bucket is lifted up from the ground.

Accordingly, as shown in FIG. 9, the slack adjustment cylinder 26 is contracted to be back to an initial position, and the slack adjustment sheave 28 moves toward the second opening/closing sheave 20 to slack the opening/closing rope 25. On the other hand, the raising/lowering cylinder 12 expands and, the first raising/lowering sheave 14 moves to be separated from the second raising/lowering sheave 17 to pull up the raising/lowering rope 24 and the first opening/closing sheave 15 moves to be separated from the second opening/closing sheave 20 to pull up the opening/closing rope 25. As a result, the raising/lowering rope 24 and the opening/closing rope 25 are pulled up to the arm 7, and the clamshell bucket 10 is lifted up by the raising/lowering rope 24 and the opening/closing rope 25 to raise in a state of holding sand and earth.

Here, in a state where the clamshell bucket 10 is closed, in some cases the opening/closing rope 25 is tensioned without the slack and the slack remains in the raising/lowering rope 24. In this case, at the time the raising/lowering cylinder 12 is expanded, the tension acting on the opening/closing rope 25 and the tension acting on the raising/lowering rope 24 become ununiform. As a result, a posture of the clamshell bucket 10 to be lifted up becomes unstable, and cargo dropping from the clamshell bucket 10 is possibly generated.

On the other hand, according to the present embodiment, at the time of pulling up the clamshell bucket 10 by expanding the raising/lowering cylinder 12, the slack adjustment cylinder 26 is caused to contract with a little delay. Thereby, while holding the tension of the opening/closing rope 25, the clamshell bucket 10 can be lifted up without generating the cargo dropping. Accordingly, at the time of lifting up the clamshell bucket 10, the tension acting on the raising/lowering rope 24 and the tension acting on the opening/closing rope 25 can be uniformed. As a result, it is possible to lift up the clamshell bucket 10 in a state of holding the stable posture and extend a lifetime of the raising/lowering rope 24 and the opening/closing rope 25.

In this way, the clamshell bucket 10 is caused to raise to the exterior of the vertical shaft. Thereafter, for example, by revolving the upper revolving structure 3, the clamshell bucket 10 is moved upward of the cargo bed in a dump truck (not shown). In this state, the operator tilts the opening/closing operation lever 39 to the contraction side. Thereby, the pilot pressure is supplied via the pilot line 41A to the opening/closing switching valve 34 to switch the opening/closing switching valve 34 to the switch position (c).

Accordingly, the opening/closing cylinder 18 is contracted and the second opening/closing sheave 20 moves toward the first opening/closing sheave 15 to pull out the opening/closing rope 25. As a result, the clamshell bucket 10 is opened, enabling the excavated sand and earth to be discharged on the cargo bed of the dump truck.

In addition, after discharging sand and earth on the cargo bed of the dump truck, the upper revolving structure 3 is caused to revolve to move the clamshell bucket 10 upward of the vertical shaft, and it is possible to excavate the vertical shaft by repeating the above-mentioned work (operation).

Thus, according to the present embodiment, the bucket raising/lowering and opening/closing device 11 in the deep foundation excavator 1 includes:

- the raising/lowering cylinder 12 disposed in the arm 7;
- the first raising/lowering sheave 14 and the first opening/closing sheave 15 that are attached to one end side of the raising/lowering cylinder 12 and move in the expansion/contraction direction of the raising/lowering cylinder 12;
- the second raising/lowering sheave 17 that is disposed in the arm 7 to be separated from the first raising/lowering sheave 14 in the expansion/contraction direction of the raising/lowering cylinder 12;
- the second opening/closing sheave 20 that is disposed in the arm 7 to be separated from the first opening/closing sheave 15 in the expansion/contraction direction of the raising/lowering cylinder 12;
- the opening/closing cylinder 18 that is disposed in the arm 7 and moves the second opening/closing sheave 20 to be closer to and to be separated from the first opening/closing sheave 15;
- the raising/lowering rope 24 having the one end 24A in the length direction attached to the arm 7, the other end 24B attached to the clamshell bucket 10 and the intermediate portion wound around the first raising/lowering sheave 14 and the second raising/lowering sheave 17; and
- the opening/closing rope 25 having the one end 25A in the length direction attached to the arm 7, the other end 25B attached to the clamshell bucket 10 and the intermediate portion wound around the first opening/closing sheave 15 and the second opening/closing sheave 20.

In addition, the deep foundation excavator 1 is provided with the slack adjustment cylinder 26 that is disposed in the arm and expands and contracts for adjusting the slack of the opening/closing rope 25 and the slack adjustment sheave 28 around which an intermediate portion of the opening/closing rope 25 is wound in a state of being attached on the one end of the slack adjustment cylinder 26 and that moves in a direction of being closer to and being separated from the second opening/closing sheave 20 in response to the expansion/contraction operation of the slack adjustment cylinder 26.

According to this configuration, after the clamshell bucket 10 held by the raising/lowering rope 24 and the opening/closing rope 25 is lowered and the lower end of the clamshell bucket 10 is landed on the ground, the raising/lowering rope 24 and the opening/closing rope 25 are caused to slack. Thereby, the clamshell bucket 10 can be made in a state of being capable of getting into under the ground by its own weight. In this state, the slack of the opening/closing rope 25 is removed by the slack adjustment cylinder 26 and the clamshell bucket 10 is closed by the opening/closing cylinder 18. Accordingly, by closing the clamshell bucket 10 while getting into under the ground, a great number of sand and earth can be shoveled by an excavating movement of one time to enhance the excavating efficiency of sand and earth.

On the other hand, at the time of lifting up the clamshell bucket 10 having excavated sand and earth from the bottom of the vertical shaft, in some cases there is no slack in the opening/closing rope 25 and the slack remains in the raising/lowering rope 24. In this case, when the raising/lowering cylinder 12 is expanded to pull up the clamshell bucket 10, the slack adjustment cylinder 26 is contracted a little later. It is possible to lift up the clamshell bucket 10 without generating the cargo dropping while holding the tension of the opening/closing rope 25. Accordingly, at the time of lifting up the clamshell bucket 10, the tension acting on the raising/lowering rope 24 and the tension acting on the opening/closing rope 25 can be uniformed. As a result, the clamshell bucket 10 can be lifted up in a state of holding the stable posture. Accordingly, by suppressing the cargo dropping from the clamshell bucket 10, the discharged sand and earth can be safely discharged on the cargo bed of the dump truck or the like. In addition, the lifetime of the raising/lowering rope 24 and the opening/closing rope 25 can be extended.

In addition, in the deep foundation excavator 1 according to the present embodiment, the swing link as similar to the bucket raising/lowering device in Patent Document 2 does not need to be attached in the arm. Therefore, the vehicle body height of the deep foundation excavator 1 at the excavating work can be suppressed to be small, and the deep foundation excavator 1 can be applied also to a working site having the height limitation in a site or the like for executing the inverted construction method, for example.

In addition, in the embodiment the raising/lowering cylinder 12, the opening/closing cylinder 18 and the slack adjustment cylinder 26 each are arranged along the longitudinal direction of the arm 7. According to this configuration, the raising/lowering cylinder 12, the opening/closing cylinder 18 and the slack adjustment cylinder 26 can be accommodated compactly in the arm 7 to downsize the working mechanism 5 in the deep foundation excavator 1 as much as possible.

Figure 10:
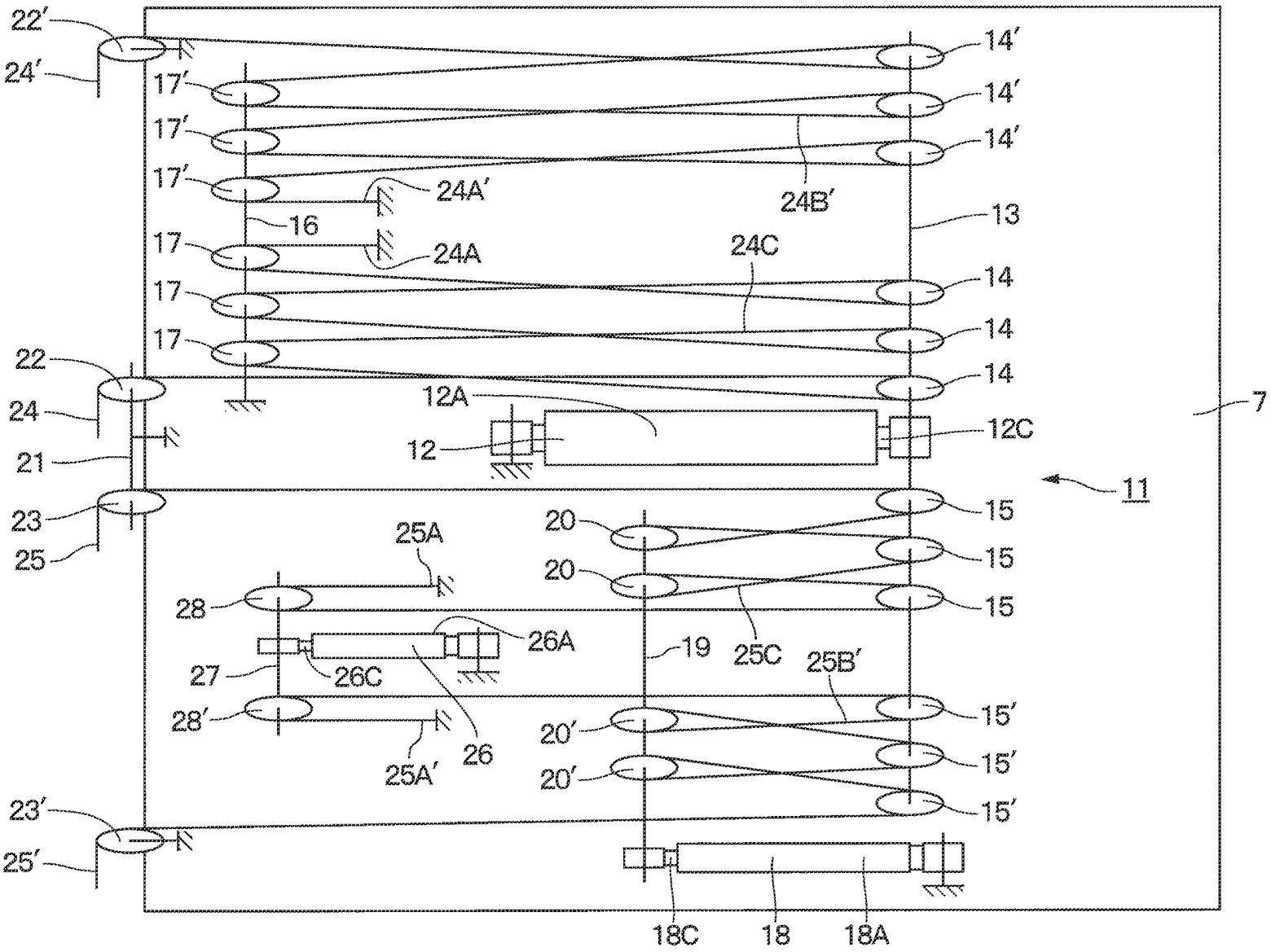
FIG. 10 is a configuration diagram schematically showing a bucket raising/lowering and opening/closing device according to a second embodiment.

Next, FIG. 10 shows a second embodiment of the present invention. The present embodiment is characterized in that a bucket raising/lowering and opening/closing device is provided with two raising/lowering ropes and two opening/closing ropes. It should be noted that components in the second embodiment identical to those in the first embodiment are referred to as identical reference numerals, and the explanation is omitted.

In the figure, an additional first raising/lowering sheave 14' composed of a plurality of sheaves configuring a bucket raising/lowering and opening/closing device 11 is rotatably supported together with the first raising/lowering sheave 14 on the first shaft member 13. An additional first opening/closing sheave 15' composed of a plurality of sheaves is rotatably supported together with the first opening/closing sheave 15 on the first shaft member 13. An additional second raising/lowering sheave 17' composed of a plurality of sheaves is rotatably supported together with the second raising/lowering sheave 17 on the second shaft member 16 in a state of being separated from the additional first raising/lowering sheave 14' in the expansion/contraction direction of the raising/lowering cylinder 12. An additional second opening/closing sheave 20' composed of a plurality of sheaves is rotatably supported together with the second opening/closing sheave 20 on the third shaft member 19 in a state of being separated from the additional first opening/ closing sheave 15' in the expansion/contraction direction of the raising/lowering cylinder 12. An additional raising/lowering guide sheave 22' and an additional opening/closing guide sheave 23' each are attached on the tip end of the arm 7.

An additional raising/lowering rope 24' is a second raising/lowering rope paired to the raising/lowering rope 24. One end 24A' of the additional raising/lowering rope 24' is attached in the arm 7. The other end (not shown) of the additional raising/lowering rope 24' extends downward from the additional raising/lowering guide sheave 22' and is attached on the bucket support portion 10A of the clamshell bucket 10. An intermediate portion 24B' of the additional raising/lowering rope 24' is wound around the additional first raising/lowering sheave 14' and the additional second raising/lowering sheave 17' alternately.

An additional opening/closing rope 25' is a second opening/closing rope paired to the opening/closing rope 25. One end 25A' (not shown) of the additional opening/closing rope 25' is attached on the arm 7. The other end of the additional opening/closing rope 25' extends downward from the additional opening/closing guide sheave 23' and is attached on the bucket support portion 10A of the clamshell bucket 10. An intermediate portion 25B' of the additional opening/closing rope 25' is wound around the additional first opening/closing sheave 15' and the additional second opening/closing sheave 20' alternately.

In this way, according to the second embodiment, the clamshell bucket 10 is supported by two raising/lowering ropes composed of the raising/lowering rope 24 and the additional raising/lowering rope 24', and two opening/closing ropes composed of the opening/closing rope 25 and the additional opening/closing rope 25'. In addition, a total of the four ropes 24, 24', 25, 25' move in synchronization with the expansion/contraction movement of the raising/lowering cylinder 12 to raise or lower the clamshell bucket 10.

An additional slack adjustment sheave 28' is rotatably supported together with the slack adjustment sheave 28 on the fifth shaft member 27 in a state of being separated from the additional second opening/closing sheave 20' in the expansion/contraction direction of the raising/lowering cylinder 12. One end 25A' of the additional opening/closing rope 25' is wound around the additional slack adjustment sheave 28'. The slack adjustment sheave 28 and the additional slack adjustment sheave 28' move in synchronization with the expansion/contraction movement of the slack adjustment cylinder 26 to adjust the slack of the opening/closing rope 25 and the slack of the additional opening/closing rope 25' simultaneously.

In the deep foundation excavator according to the second embodiment, the clamshell bucket 10 is supported by the two raising/lowering ropes composed of the raising/lowering rope 24 and the additional raising/lowering rope 24', and the two opening/closing ropes composed of the opening/closing rope 25 and the additional opening/closing rope 25'. The second embodiment is not particularly different in a basic function from the first embodiment. However, according to the second embodiment, the clamshell bucket 10 is supported by a total of the four ropes 24, 24', 25, 25' and therefore, the stability of the clamshell bucket 10 at the raising/lowering can be enhanced. Further, the bucket raising/lowering and opening/closing device 11 can be configured to meet the objects of extending the lifetime of each of the ropes 24, 24', 25, 25' and enhancing the maintenance characteristics by thinning down each of the ropes 24, 24', 25, 25'.

Figure 11:
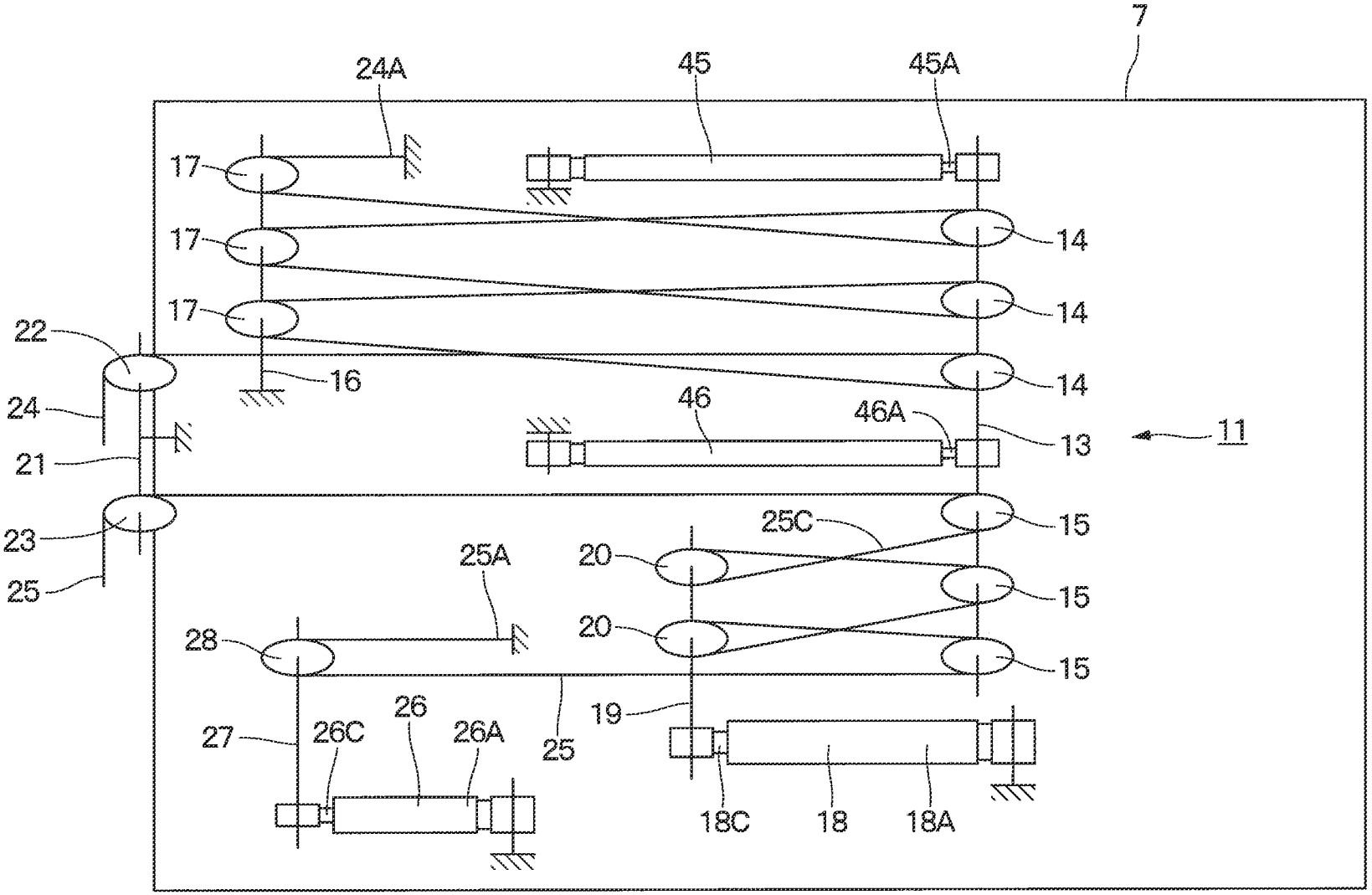
FIG. 11 is a configuration diagram schematically showing a bucket raising/lowering and opening/closing device according to a third embodiment.
Figure 12:
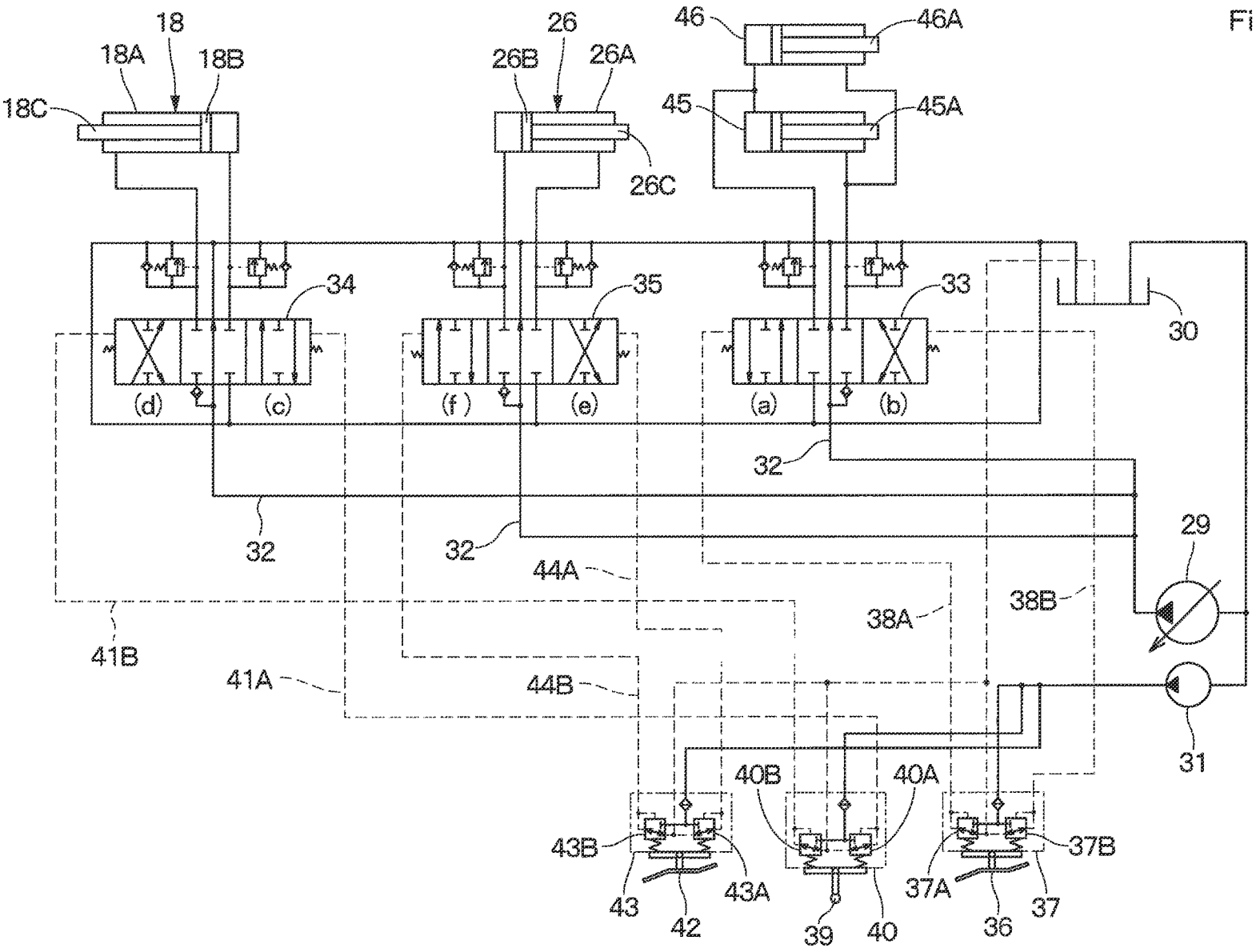
FIG. 12 is a hydraulic circuit diagram of the bucket raising/lowering and opening/closing device according to the third embodiment.

Next, FIG. 11 and FIG. 12 show a third embodiment of the present invention. The present embodiment is characterized in that a raising/lowering cylinder in a bucket raising/lowering and opening/closing device comprises two raising/lowering cylinders. It should be noted that components in the third embodiment identical to those in the first embodiment are referred to as identical reference numerals, and the explanation is omitted.

In the figure, two raising/lowering cylinders 45, 46 configuring a bucket raising/lowering and opening/closing device 11 each are arranged in the arm 7 along the longitudinal direction of the arm 7. The two raising/lowering cylinders 45, 46 each have an outer diameter dimension set to be smaller than the raising/lowering cylinder 12 used in the first embodiment. The first shaft member 13 is attached on a rod 45A of one raising/lowering cylinder 45 and a rod 46A of the other raising/lowering cylinder 46.

As shown in FIG. 12, the two raising/lowering cylinders 45, 46 are connected via the main line 32 in parallel to the hydraulic pump 29. Accordingly, when the raising/lowering operation pedal 36 is depressed to the expansion side, the pilot pressure is supplied via the pilot line 38B to the raising/lowering switching valve 33 to switch the raising/lowering switching valve 33 to the switch position (b). Thereby, the hydraulic oil is simultaneously supplied to bottom-side oil chambers of the raising/lowering cylinders 45, 46 to expand the raising/lowering cylinders 45, 46 in synchronization. In addition, when the raising/lowering operation pedal 36 is depressed to the contraction side, the pilot pressure is supplied via the pilot line 38A to the raising/lowering switching valve 33 to switch the raising/lowering switching valve 33 to the switch position (a). Thereby, the hydraulic oil is simultaneously supplied to rod-side oil chambers of the raising/lowering cylinders 45, 46 to contract the raising/lowering cylinders 45, 46 in synchronization.

The deep foundation excavator according to the third embodiment is provided with the two raising/lowering cylinders 45, 46, and the third embodiment is not particularly different in a basic function from the first embodiment. However, according to the third embodiment, in a case where an equipment accommodation space within the arm 7 is narrow, even in a case where it is difficult to lay out the single raising/lowering cylinder 12 with a large outer diameter dimension within the arm 7, use of the two raising/lowering cylinders 45, 46 smaller in an outer diameter dimension than the raising/lowering cylinder 12 enables the layout within the arm 7.

It should be noted that the first embodiment shows a case of operating the raising/lowering cylinder 12 by the depression operation of the raising/lowering operation pedal 36, as an example. However, the present invention is not limited thereto, but the raising/lowering cylinder 12 may be operated by a tilting operation of a raising/lowering operation lever. As similar to this, the opening/closing cylinder 18 may be operated by an opening/closing operation pedal in place of the opening/closing operation lever 39, and the slack adjustment cylinder 26 may be operated by a slack operation lever in place of the slack operation pedal 42.

In addition, the first embodiment shows a case where the hydraulic oil delivered from the single hydraulic pump 29 is selectively supplied to the raising/lowering cylinder 12, the opening/closing cylinder 18 and the slack adjustment cylinder 26. However, the present invention is not limited thereto, but for example, three hydraulic pumps (triple pump) simultaneously driven by a prime mover may be used, wherein the hydraulic oil from the three hydraulic pumps may be supplied to a raising/lowering cylinder, an opening/closing cylinder and a slack adjustment cylinder individually.

Figure 13:
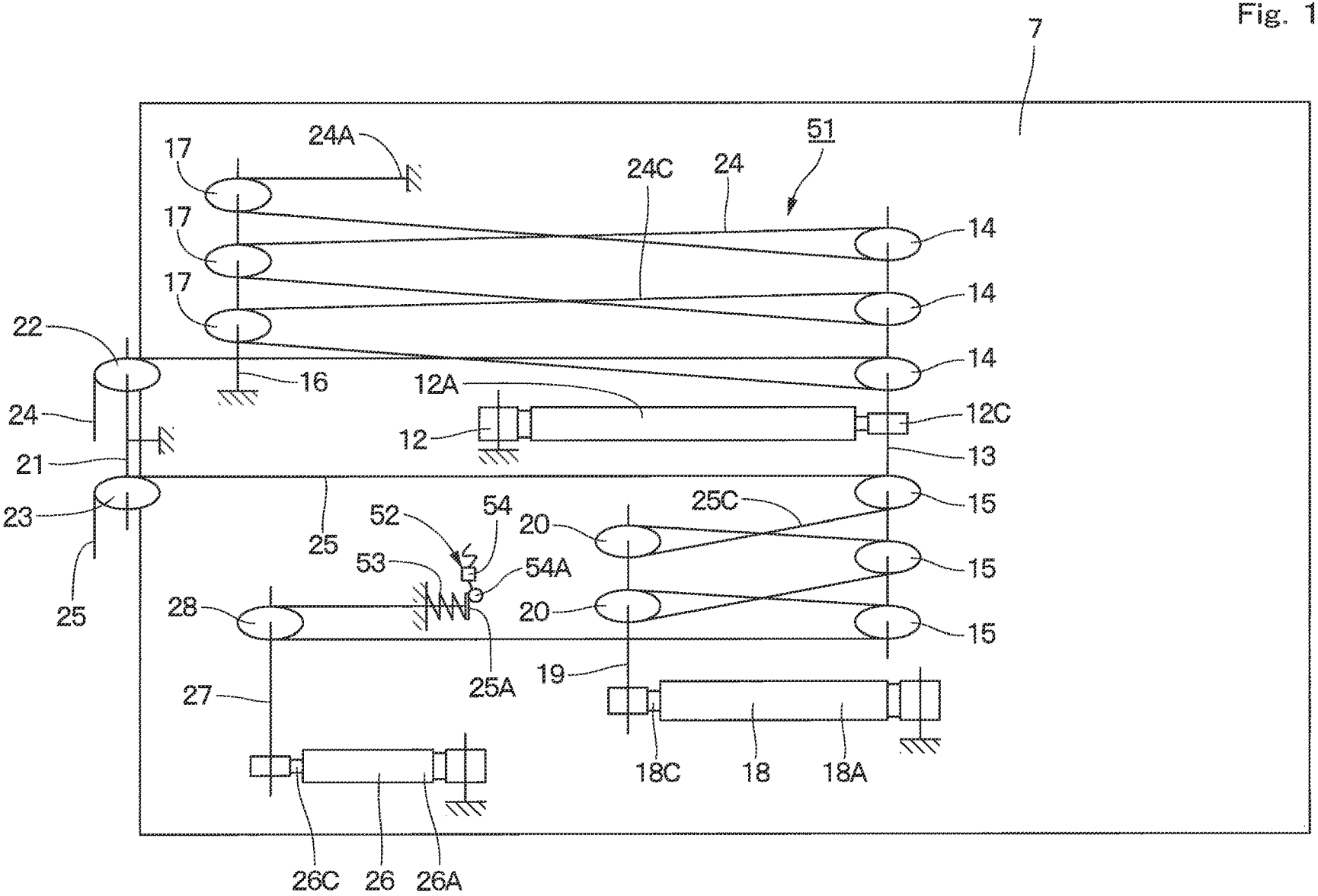
FIG. 13 is a configuration diagram schematically showing a bucket raising/lowering and opening/closing device according to a fourth embodiment.
Figure 14:
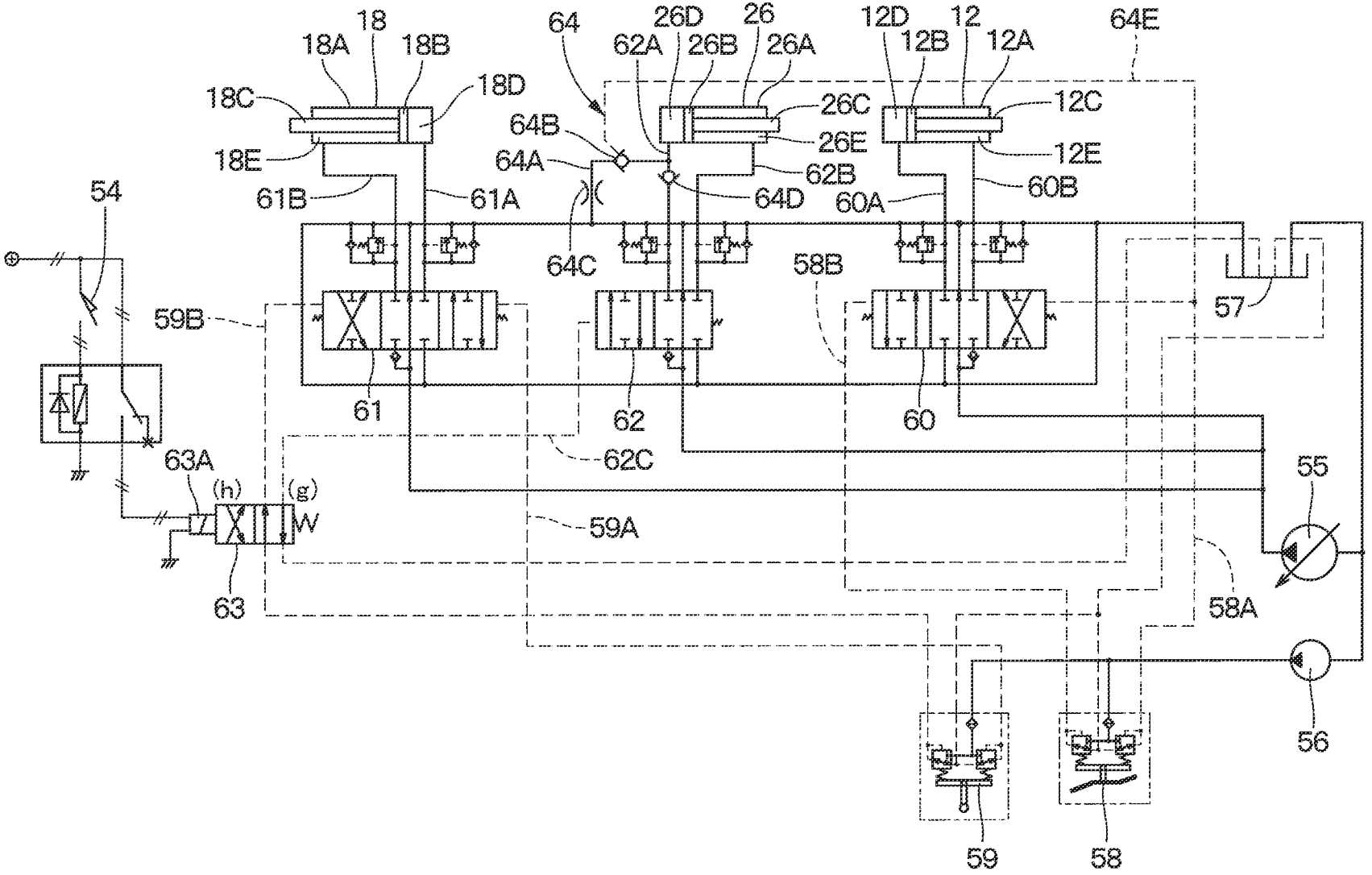
FIG. 14 is a hydraulic circuit diagram of the bucket raising/lowering and opening/closing device according to the fourth embodiment.

Next, FIG. 13 and FIG. 14 show a fourth embodiment of the present invention. The present embodiment is characterized in that when it is detected that a tension acting on an opening/closing rope is equal to or less than a predetermined value, an operation target of an opening/closing operation tool is switched to a slack adjustment cylinder from an opening/closing cylinder. It should be noted that components in the fourth embodiment identical to those in the first embodiment are referred to as identical reference numerals, and the explanation is omitted.

As described above, after slacking the opening/closing rope 25 so that the clamshell bucket 10 gets into under the ground, the slack operation pedal 42 is operated to remove the slack of the opening/closing rope 25. In this way, by operating the opening/closing operation lever 39 in a state of in advance removing the slack of the opening/closing rope 25, the clamshell bucket 10 can quickly be closed to enhance the workability of the excavating work.

However, after the clamshell bucket 10 is landed, how much the slack is formed in the opening/closing rope 25 depends upon a level of skill of an operator of operating the slack operation pedal 42. Therefore, in the fourth embodiment, regardless of the level of skill of an operator, an appropriate slack is formed in the opening/closing rope 25 and also the clamshell bucket 10 is quickly closed when the clamshell bucket 10 is landed, thus enabling the clamshell bucket 10 to shovel sand and earth efficiently.

As shown in FIG. 13, a bucket raising/lowering and opening/closing device 51 according to the fourth embodiment, as similar to the bucket raising/lowering and opening/closing device according to the first embodiment, includes the raising/lowering cylinder 12, the first raising/lowering sheave 14, the first opening/closing sheave 15, the second raising/lowering sheave 17, the opening/closing cylinder 18, the second opening/closing sheave 20, the raising/lowering rope 24, the opening/closing rope 25, the slack adjustment cylinder 26, and the slack adjustment sheave 28. However, the bucket raising/lowering and opening/closing device 51 according to the fourth embodiment is different, in a point where a detecting device 52 configured to detect the slack of the opening/closing rope 25 is disposed, from the first embodiment.

Next, an explanation will be in detail made of the configuration and function of the detecting device 52 disposed in the bucket raising/lowering and opening/closing device 51.

The detecting device 52 is disposed between the arm 7 and the one end 25A of the opening/closing rope 25. The detecting device 52 is configured of a spring member 53 and a detector 54. The spring member 53 is formed as a compression spring tightly held between the arm 7 and the one end 25A of the opening/closing rope 25. The spring member 53 is set to have load characteristics to be compressed in a state where the clamshell bucket 10 is suspended to the arm 7. That is, the spring member 53 contracts by the weight of the clamshell bucket 10. On the other hand, as shown in FIG. 1, when the opening/closing rope 25 is slacked by the clamshell bucket 10 being landed, the spring member 53 expands.

The detector 54 detects the slack of the opening/closing rope 25, that is, a free state of the spring member 53. The detector 54 is formed as a contact type sensor (switch) that switches between an on state and an off state in response to an inclination of a lever 54A. On the other hand, a non-contact type sensor that switches between an on state and an off state by a change of a magnetic force or an optical source may be used as a detector.

When the spring member 53 is compressed, as the one end 25A of the opening/closing rope 25 moves in a direction of being separated from the lever 54A and the lever 54A returns back to an initial position, the detector 54 turns off. On the other hand, when the opening/closing rope 25 is slacked and the one end 25A of the opening/closing rope 25 pushes the lever 54A by the spring member 53, the lever 54A is inclined to switch the detector 54 to the on state. Since the detector 54 is switched to the on state when the tension acting on the opening/closing rope 25 becomes equal to or less than a predetermined value, power is fed to an electromagnetic pilot portion 63A of an after-mentioned cylinder switching valve 63 based upon a detection signal at this time.

Next, an explanation will be made of a hydraulic circuit for driving the raising/lowering cylinder 12, the opening/closing cylinder 18 and the slack adjustment cylinder 26 in the bucket raising/lowering and opening/closing device 51.

The upper revolving structure 3 includes a main pump 55, a pilot pump 56 and a hydraulic oil tank 57. In addition, the cab 4 is provided with a raising/lowering operation tool 58 and an opening/closing operation tool 59 each composed of an operation lever, an operation pedal and the like.

The raising/lowering operation tool 58 is connected via a first pilot line 58A and a second pilot line 58B to a raising/lowering switching valve 60. This raising/lowering switching valve 60 has three positions of a closing position for stopping the expansion/contraction movement of the raising/lowering cylinder 12, an expansion position for expanding the rod 12C of the raising/lowering cylinder 12, and a contraction position for contracting the rod 12C of the raising/lowering cylinder 12. The raising/lowering switching valve 60 is operated to be switched to the three positions by the raising/lowering operation tool 58.

The raising/lowering switching valve 60 is connected via a bottom-side line 60A to a bottom-side oil chamber 12D in the raising/lowering cylinder 12 and is connected via a rod-side line 60B to a rod-side oil chamber 12E in the raising/lowering cylinder 12. Here, an additional pilot line 64E for supplying a pilot pressure to an after-mentioned pilot operation check valve 64B is connected to the first pilot line 58A for switching the raising/lowering switching valve 60 to the expansion position.

The opening/closing operation tool 59 is connected via a first pilot line 59A and a second pilot line 59B to an opening/closing switching valve 61. This opening/closing switching valve 61 has, as similar to the raising/lowering switching valve 60, three positions of a closing position for stopping the expansion/contraction movement of the opening/closing cylinder 18, an expansion position for expanding the rod 18C of the opening/closing cylinder 18, and a contraction position for contracting the rod 18C of the opening/closing cylinder 18. The opening/closing switching valve 61 is operated to be switched to the three positions by the opening/closing operation tool 59.

The opening/closing switching valve 61 is connected via a bottom-side line 61A to a bottom-side oil chamber 18D in the opening/closing cylinder 18 and is connected via a rod-side line 61B to a rod-side oil chamber 18E in the opening/closing cylinder 18. Here, an after-mentioned cylinder switching valve 63 is connected to the second pilot line 59B for switching the opening/closing switching valve 61 to the expansion side of the rod 18C in the opening/closing cylinder 18.

A slack removal switching valve 62 has two positions of a closing position for stopping the expansion/contraction movement of the slack adjustment cylinder 26 and an expansion position for expanding the rod 26C of the slack adjustment cylinder 26. The slack removal switching valve 62 is operated to be switched to the two positions by the opening/closing operation tool 59 or the like.

The slack removal switching valve 62 is connected via a bottom-side line 62A to a bottom-side oil chamber 26D in the slack adjustment cylinder 26 and is connected via a rod-side line 62B to a rod-side oil chamber 26E in the slack adjustment cylinder 26. Here, the slack removal switching valve 62 is provided with a pilot line 62C to switch the slack removal switching valve 62 to the expansion position.

The pilot line 62C of the slack removal switching valve 62 is connected via the cylinder switching valve 63 to the hydraulic oil tank 57 or the opening/closing operation tool 59.

The cylinder switching valve 63 is disposed along the path of the second pilot line 59B of the opening/closing operation tool 59 and the pilot line 62C of the slack removal switching valve 62. The cylinder switching valve 63 switches, when the detector 54 in the detecting device 52 detects that the tension acting on the opening/closing rope 25 is equal to or less than a predetermined value, the operation target of the opening/closing operation tool 59 from the opening/closing cylinder 18 to the slack adjustment cylinder 26.

The cylinder switching valve 63 has two positions of a switch position (g) in which the pilot pressure (hydraulic oil) from the opening/closing operation tool 59 can be supplied to the opening/closing switching valve 61 and a switch position (h) in which the pilot pressure from the opening/closing operation tool 59 can be supplied to the slack removal switching valve 62. In the cylinder switching valve 63, an electromagnetic pilot portion 63A is connected to the detector 54 in the detecting device 52. Thereby, the cylinder switching valve 63 is switched to the switch position (h) by the power feeding to the electromagnetic pilot portion 63A when the detector 54 turns on.

A cylinder contraction device 64 contracts the rod 26C in the slack adjustment cylinder 26 when the raising/lowering operation tool 58 is operated to a raising side of raising the clamshell bucket 10. As described in more detail, after the operation target of the opening/closing operation tool 59 is switched to the slack adjustment cylinder 26 to expand the rod 26C, when the raising/lowering operation tool 58 is operated to raise the clamshell bucket 10, the cylinder contraction device 64 contracts the rod 26C in the slack adjustment cylinder 26.

The cylinder contraction device 64 includes a discharge liquid line 64A for connection between the bottom-side oil chamber 26D in the slack adjustment cylinder 26 and the hydraulic oil tank 57, a pilot operation check valve 64B and a throttle 64C arranged in the discharge liquid line 64A, a check valve 64D disposed in the bottom-side line 62A in the slack removal switching valve 62 and an additional pilot line 64E for connection between the first pilot line 58A in the raising/lowering operation tool 58 and the pilot operation check valve 64B.

The pilot operation check valve 64B is usually closed to block the discharge liquid line 64A. On the other hand, the pilot operation check valve 64B is opened when the pilot pressure is supplied from the additional pilot line 64E to cause the hydraulic oil to flow in the discharge liquid line 64A. At this time, the throttle 64C restricts a speed by which the rod 26C in the slack adjustment cylinder 26 contracts by throttling a flow amount of the hydraulic oil. In addition, the check valve 64D prevents the hydraulic oil in the bottom-side oil chamber 26D from flowing back to the slack removal switching valve 62-side.

On top of that, the additional pilot line 64E supplies the pilot pressure toward the pilot operation check valve 64B when the raising/lowering operation tool 58 is operated to the raising side to raise the clamshell bucket 10. Thereby, the hydraulic oil of the bottom-side oil chamber 26D in the slack adjustment cylinder 26 is discharged via the discharge liquid line 64A and the like to the hydraulic oil tank 57. That is, when the raising/lowering operation tool 58 is operated to the raising side to raise the clamshell bucket 10, in a case where the rod 26C in the slack adjustment cylinder 26 is expanded, the rod 26C is gradually contracted to become in the most contracted state.

Next, an explanation will be made of one example of an operation procedure at the time of excavating the vertical shaft using the bucket raising/lowering and opening/closing device 51 in the present embodiment and the clamshell bucket 10.

An operator who gets in the cab 4 arranges the clamshell bucket 10 over the excavating position in a state where the clamshell bucket 10 is closed. In the suspending state of the clamshell bucket 10, since the spring member 53 is compressed by the weight of the clamshell bucket 10, the detector 54 of the detecting device 52 is in an off state. When the clamshell bucket 10 is arranged over the excavating position, the raising/lowering operation tool 58 is operated to the lowering side. Thereby, the raising/lowering switching valve 60 is switched to the contraction position by the pilot pressure from the second pilot line 58B to contract the raising/lowering cylinder 12. When the raising/lowering cylinder 12 is contracted, each sheave of the first raising/lowering sheave 14 moves to each sheave side of the second raising/lowering sheave 17 and each sheave of the first opening/closing sheave 15 moves to each sheave side of the second opening/closing sheave 20. Therefore, the raising/lowering rope 24 and the opening/closing rope 25 are sent out from the arm 7 to lower the clamshell bucket 10.

When the clamshell bucket 10 reaches a position several meters (for example, 2 to 3 meters) from the ground following the lowering movement of the clamshell bucket 10, an operator operates the opening/closing operation tool 59 to the opening side to fully open each of the buckets 10B in the clamshell bucket 10. When the clamshell bucket 10 is fully opened, the raising/lowering operation tool 58 is again operated to the lowering side to lower the clamshell bucket 10.

As shown in FIG. 1, when the clamshell bucket 10 is landed on the ground, the operator further operates the raising/lowering operation tool 58 to the lowering side, the slack corresponding to the extent that the clamshell bucket 10 gets into under the ground is formed in the raising/lowering rope 24 and the opening/closing rope 25.

When the excavation slack is formed in the raising/lowering rope 24 and the opening/closing rope 25, the opening/closing operation tool 59 is operated to the closing side. Here, in a state where the clamshell bucket 10 is landed on the ground, since the opening/closing rope 25 is slacked, the detector 54 of the detecting device 52 detects the slack of the spring member 53 to feed power to the electromagnetic pilot portion 63A of the cylinder switching valve 63.

Accordingly, the cylinder switching valve 63 is switched to the switch position (h) in which the pilot pressure from the opening/closing operation tool 59 can be supplied to the slack removal switching valve 62. Thereby, since the pilot pressure from the opening/closing operation tool 59 switches the slack removal switching valve 62 to the expansion position, the slack adjustment cylinder 26 automatically removes the slack of the opening/closing rope 25 by expanding the rod 26C. Further, when the slack of the opening/closing rope 25 is removed, since a predetermined value or more of tensions are applied to the opening/closing rope 25, the cylinder switching valve 63 is automatically switched back to the switch position (g).

Thereby, an operator can close the clamshell bucket 10 by the opening/closing operation tool 59. At the closing operation of the clamshell bucket 10, it is possible to automatically remove the slack of the opening/closing rope 25 unintentionally.

Next, when sand and earth is excavated by closing the clamshell bucket 10, the raising/lowering operation tool 58 is operated to the raising side to raise the clamshell bucket 10. In this case, since the opening/closing rope 25 is in a tensioning state where the slack is removed by the slack adjustment cylinder 26, when the clamshell bucket 10 is raised in this state, the clamshell bucket 10 results in being suspended by the opening/closing rope 25 only.

In the present embodiment, however, when the raising/lowering operation tool 58 is operated to the raising side, part of the pilot pressure to be supplied via the first pilot line 58A to the raising/lowering switching valve 60 is supplied via the additional pilot line 64E to the pilot operation check valve 64B of the cylinder contraction device 64. Accordingly, in the cylinder contraction device 64 the pilot operation check valve 64B is opened to discharge the hydraulic oil in the bottom-side oil chamber 26D of the slack adjustment cylinder 26 to the hydraulic oil tank 57-side. Thereby, the slack adjustment cylinder 26 contracts the rod 26C. At this time, the throttle 64C throttles the flow amount of the hydraulic oil to flow out from the bottom-side oil chamber 26D, thus making it possible to gradually contract the rod 26C of the slack adjustment cylinder 26.

That is, the cylinder contraction device 64 contracts, at the time of raising the clamshell bucket 10, the rod 26C of the slack adjustment cylinder 26 together with the raising operation, thereby making it possible to raise the clamshell bucket 10 in the stable state while tailoring the tensions of two ropes of the raising/lowering rope 24 and the opening/closing rope 25. In addition, the cylinder contraction device 64 gradually contracts the rod 26C of the slack adjustment cylinder 26 so that the tension of the opening/closing rope 25 does not become smaller than the tension of the raising/lowering rope 24. Thereby, the clamshell bucket 10 can be raised in the stable state.

When the clamshell bucket 10 is dynamically lifted off, the raising/lowering operation tool 58 is successively operated to expand the raising/lowering cylinder 12 and raise the clamshell bucket 10. When the clamshell bucket 10 is pulled up, for example, to the ground, the clamshell bucket 10 moves upward of a dump truck (not shown) or the like. By operating the opening/closing operation tool 59 to the opening side and slacking the opening/closing rope 25, the clamshell bucket 10 is opened to discharge the soil on the cargo bed of the dump truck. At the soil discharging, since the slack adjustment cylinder 26 is in the most contracted state, even when the opening/closing rope 25 is slacked, the clamshell bucket 10 can be held by the raising/lowering rope 24.

After sand and earth is loaded on the cargo bed of the dump truck, the clamshell bucket 10 is moved back over the vertical shaft, and by repeating the above-mentioned work (operation), the deep foundation excavator 1 can excavate the vertical shaft.

Thus, according to the present embodiment, the bucket raising/lowering and opening/closing device 51 includes the raising/lowering operation tool 58 for operating the raising/lowering cylinder 12, the opening/closing operation tool 59 for operating the opening/closing cylinder 18, the detector 54 in the detecting device 52 for detecting whether or not the tension acting on the opening/closing rope 25 is equal to or less than the predetermined value, the cylinder switching valve 63 for switching the operation target of the opening/closing operation tool 59 from the opening/closing cylinder 18 to the slack adjustment cylinder 26 when the detector 54 detects the tension acting on the opening/closing rope 25 is equal to or less than the predetermined value, and the cylinder contraction device 64 for contracting the slack adjustment cylinder 26.

Accordingly, at the excavating work of the vertical shaft, the tensions acting on the raising/lowering rope 24 and the opening/closing rope 25 can be automatically tailored in accordance with the operation condition, and therefore, the dynamic lift off work from the excavation and the soil discharging work to the dump truck can be stably carried out. As a result, the excavating work by the clamshell bucket 10 can be easily and accurately operated regardless of the level of skill.

In addition, when the tension is caused to act equally on the raising/lowering rope 24 and the opening/closing rope 25, it is possible to improve the durability on each of the rope 24 and the rope 25. On the other hand, since the plurality of sheaves overlap in each of the sheaves 14, 15, 17, 20 for arrangement, the stroke of the raising/lowering cylinder 12 can be shortened to downsize the bucket raising/lowering and opening/closing device 51. Thereby, the workability in the narrow working site can improve. Further, the raising/lowering cylinder 12 and the opening/closing cylinder 18, and the slack adjustment cylinder 26 are arranged in parallel in the lateral direction of the arm 7, and also in this respect, the bucket raising/lowering and opening/closing device 51 can be downsized.

Figure 15:
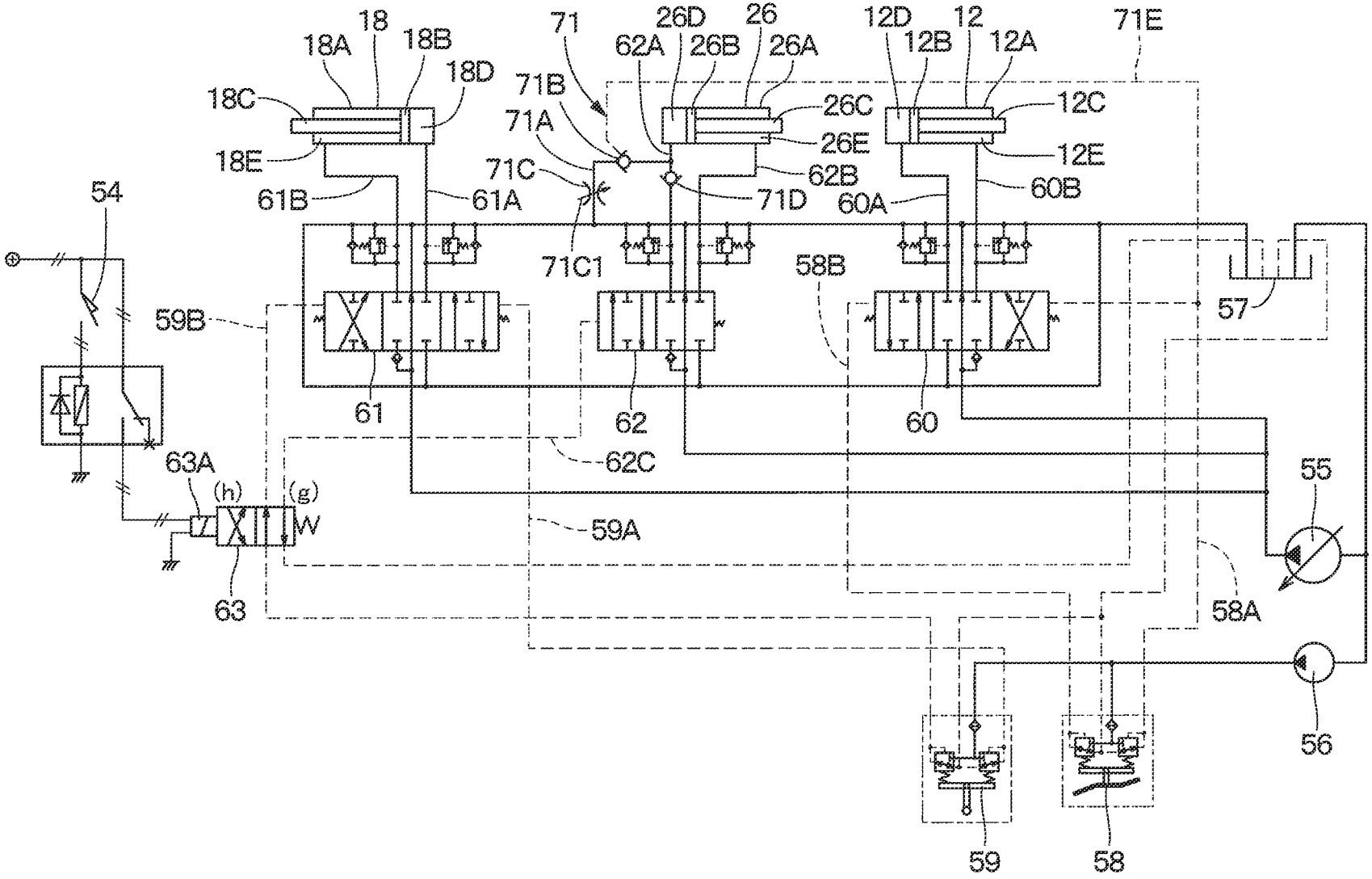
FIG. 15 is a hydraulic circuit diagram of a bucket raising/lowering and opening/closing device according to a fifth embodiment.

Next, FIG. 15 shows a fifth embodiment of the present invention. The present embodiment is characterized in that a throttle of a cylinder contraction device is provided with an adjustment portion for adjusting a flow amount of hydraulic oil. It should be noted that components in the fifth embodiment identical to those in the fourth embodiment are referred to as identical reference numerals, and the explanation is omitted.

In FIG. 15, a cylinder contraction device 71 according to the fifth embodiment includes, as similar to the cylinder contraction device 64 according to the fourth embodiment, a discharge liquid line 71A, a pilot operation check valve 71B, a throttle 71C, a check valve 71D and an additional pilot line 71E. However, the cylinder contraction device 71 according to the fifth embodiment is different in a point where the throttle 71C is provided with an adjustment portion 71C1 from the cylinder contraction device 64 according to the fourth embodiment. The adjustment portion 71C1 of the throttle 71C adjusts, for example, an opening area to adjust the flow amount of the hydraulic oil for communication.

In this way, even in the fifth embodiment as configured above, the function and effect as substantially similar to the above-mentioned fourth embodiment can be obtained. Particularly according to the fifth embodiment, the adjustment portion 71C1 can adjust the time until the rod 26C in the slack adjustment cylinder 26 is contracted to the maximum. As a result, the movement of the slack adjustment cylinder 26 can be adjusted in accordance with the hardness of sand and earth to be excavated or the preference of an operator to enhance the working efficiency.

Figure 16:
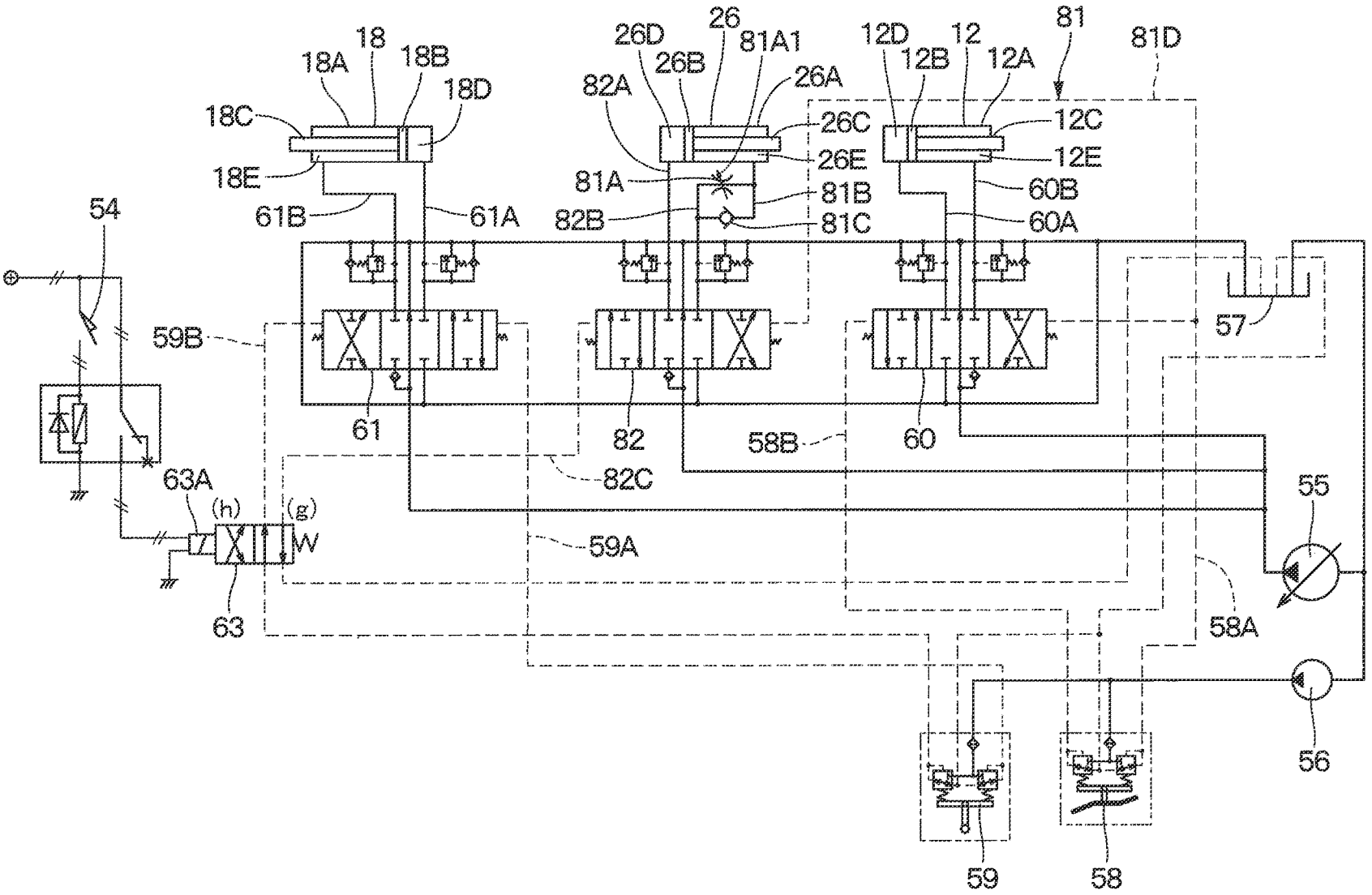
FIG. 16 is a hydraulic circuit diagram of a bucket raising/lowering and opening/closing device according to a sixth embodiment.

Next, FIG. 16 shows a sixth embodiment of the present invention. The present embodiment is characterized in that a cylinder contraction device is provided with a forced switch pilot line for switching a slack removal switching valve so that when a raising/lowering operation tool is operated to a raising side to raise a clamshell bucket, hydraulic oil is supplied to a rod-side oil chamber in a slack removal cylinder. It should be noted that components in the sixth embodiment identical to those in the fourth embodiment are referred to as identical reference numerals, and the explanation is omitted.

In FIG. 16, a cylinder contraction device 81 according to the sixth embodiment includes a throttle 81A with an adjustment portion 81A1 disposed in a rod-side line 82B of a slack removal switching valve 82, a check valve 81C disposed in a bypass line 81B for bypassing the throttle 81A, and a forced switch pilot line 81D for connection between the first pilot line 58A of the raising/lowering operation tool 58 and the slack removal switching valve 82. The slack removal switching valve 82 is provided with a bottom-side line 82A and a pilot line 82C.

The throttle 81A restricts a speed by which the rod 26C in the slack adjustment cylinder 26 contracts by throttling the flow amount of the hydraulic oil. In addition, the adjustment portion 81A1 can adjust the time until the rod 26C in the slack adjustment cylinder 26 is contracted to the maximum.

In addition, the check valve 81C allows the hydraulic oil in the rod-side oil chamber 26E to flow to the slack removal switching valve 82-side and blocks the reverse flow. That is, in a case of contracting the rod 26C in the slack adjustment cylinder 26, since the flow amount of the hydraulic oil is throttled by the throttle 81A, the rod 26C is gradually contracted.

Further, the forced switch pilot line 81D switches the slack removal switching valve 82 so that when the raising/lowering operation tool 58 is operated to the raising side to raise the clamshell bucket 10, the hydraulic oil is supplied to the rod-side oil chamber 26E in the slack adjustment cylinder 26.

In the cylinder contraction device 81 as configured in this way, when the raising/lowering operation tool 58 is operated to the raising side to raise the clamshell bucket 10, the forced switch pilot line 81D switches the slack removal switching valve 82 to the contraction position using part of the pilot pressure supplied via the first pilot line 58A to the raising/lowering switching valve 60. Thereby, the slack removal switching valve 82 supplies the hydraulic oil via the rod-side line 82B to the rod-side oil chamber 26E in the slack adjustment cylinder 26. At this time, the throttle 81A restricts a speed by which the rod 26C in the slack adjustment cylinder 26 contracts by throttling the flow amount of the hydraulic oil. In addition, an adjustment portion 81A11 can adjust the time until the rod 26C in the slack adjustment cylinder 26 is contracted to the maximum.

In this way, also in the sixth embodiment as thus configured, the function and effect as substantially similar to the above-mentioned fourth and fifth embodiments can be obtained.

It should be noted that in the first embodiment, FIG. 1 shows a state of carrying out the excavating work while holding the arm 7 in the horizontal posture. However, the present invention is not limited thereto, but an excavating work of a vertical shaft may be carried out in another posture of the arm 7, such as a vertical posture or an inclined posture. This configuration can be applied similarly to the other embodiments each.

In addition, the first embodiment is configured so that the clamshell bucket 10 lowers at the time of contracting the rod 12C in the raising/lowering cylinder 12 and raises at the time of expanding the rod 12C in the raising/lowering cylinder 12. However, the present invention is not limited thereto, but may be configured so that the clamshell bucket 10 raises at the time of contracting the rod 12C in the raising/lowering cylinder 12 and lowers at the time of expanding the rod 12C in the raising/lowering cylinder 12. Similarly the expansion/contraction movement of the opening/closing cylinder 18 and the opening/closing movement of the clamshell bucket 10 may be reversed to each other. Further, the expansion/contraction movement of the slack adjustment cylinder 26 and the slack removal movement by the slack adjustment sheave 28 may be reversed to each other. These configurations can be applied similarly to the other embodiments.

Further, in the first embodiment, there is shown a case as an example where the arm 7 is formed as the long square cylindrical body and the bucket raising/lowering and opening/closing device 11 is mounted on the outer periphery of the arm 7. However, the present invention is not limited thereto, but may be configured so that, for example, the arm 7 is formed as the long square cylindrical body and the bucket raising/lowering and opening/closing device 11 is disposed inside the arm 7. This configuration can be applied similarly to the other embodiments each.

DESCRIPTION OF REFERENCE NUMERALS

1: DEEP FOUNDATION EXCAVATOR
2: LOWER TRAVELING STRUCTURE (VEHICLE BODY)
3: UPPER REVOLVING STRUCTURE (VEHICLE BODY)
5: WORKING MECHANISM
6: BOOM
7: ARM
10: CLAMSHELL BUCKET
11, 51: BUCKET RAISING/LOWERING AND OPENING/CLOSING DEVICE
12, 45, 46: RAISING/LOWERING CYLINDER
14: FIRST RAISING/LOWERING SHEAVE
14': ADDITIONAL FIRST RAISING/LOWERING SHEAVE
15: FIRST OPENING/CLOSING SHEAVE
15': ADDITIONAL FIRST OPENING/CLOSING SHEAVE
17: SECOND RAISING/LOWERING SHEAVE
17': ADDITIONAL SECOND RAISING/LOWERING SHEAVE
18: OPENING/CLOSING CYLINDER
20: SECOND OPENING/CLOSING SHEAVE
20': ADDITIONAL SECOND OPENING/CLOSING SHEAVE
24: RAISING/LOWERING ROPE
24': ADDITIONAL RAISING/LOWERING ROPE
24A, 25A, 24A': ONE END
24B, 25B: OTHER END
24C, 25C, 24B': INTERMEDIATE PORTION
25: OPENING/CLOSING ROPE
26: SLACK ADJUSTMENT CYLINDER
28: SLACK ADJUSTMENT SHEAVE
28': ADDITIONAL SLACK ADJUSTMENT SHEAVE

54: DETECTOR
58: RAISING/LOWERING OPERATION TOOL
59: OPENING/CLOSING OPERATION TOOL
60: RAISING/LOWERING SWITCHING VALVE
61: OPENING/CLOSING SWITCHING VALVE
62, 82: SLACK REMOVAL SWITCHING VALVE
63: CYLINDER SWITCHING VALVE
64, 71, 81: CYLINDER CONTRACTION DEVICE
64A, 71A: DISCHARGE LIQUID LINE
64B, 71B: PILOT OPERATION CHECK VALVE
64C, 71C, 81C: THROTTLE
81D: FORCED SWITCH PILOT LINE

The invention claimed is:

1. A deep foundation excavator comprising:
an automotive vehicle body; and
a working mechanism disposed in the vehicle body,
wherein the working mechanism includes:
a boom disposed in the vehicle body;
an arm disposed in a tip end of the boom;
a bucket raising/lowering and opening/closing device disposed in the arm; and
a clamshell bucket that is disposed to be capable of raising and lowering to the arm and excavates a vertical shaft by a raising/lowering movement and an opening/closing movement of the bucket raising/lowering and opening/closing device,
wherein the bucket raising/lowering and opening/closing device includes:
a raising/lowering cylinder disposed in the arm;
a first raising/lowering sheave and a first opening/closing sheave that are attached to one end side of the raising/lowering cylinder and move in an expansion/contraction direction of the raising/lowering cylinder;
a second raising/lowering sheave that is disposed in the arm to be separated from the first raising/lowering sheave in the expansion/contraction direction of the raising/lowering cylinder;
a second opening/closing sheave that is disposed in the arm to be separated from the first opening/closing sheave in the expansion/contraction direction of the raising/lowering cylinder;
an opening/closing cylinder that is disposed in the arm and moves the second opening/closing sheave to be closer to and to be separated from the first opening/closing sheave;
a raising/lowering rope having one end in a length direction attached to the arm, the other end attached to the clamshell bucket and an intermediate portion wound around the first raising/lowering sheave and the second raising/lowering sheave; and
an opening/closing rope having one end in a length direction attached to the arm, the other end attached to the clamshell bucket and an intermediate portion wound around the first opening/closing sheave and the second opening/closing sheave,
wherein the bucket raising/lowering and opening/closing device further includes:
a slack adjustment cylinder that is disposed in the arm and expands and contracts for adjusting the slack of the opening/closing rope; and
a slack adjustment sheave around which an intermediate portion of the opening/closing rope is wound in a state of being attached on one end of the slack adjustment cylinder and that moves in a direction of being closer to and being separated from the second opening/closing sheave in response to an expansion/contraction movement of the slack adjustment cylinder, and
wherein the bucket raising/lowering and opening/closing device further includes:
an opening/closing operation tool configured to operate the opening/closing cylinder;
a raising/lowering operation tool configured to operate the raising/lowering cylinder;
a detector configured to detect whether or not a tension acting on the opening/closing rope is equal to or less than a predetermined value;
a cylinder switching valve configured to switch an operation target of the opening/closing operation tool from the opening/closing cylinder to the slack adjustment cylinder when the detector detects that the tension acting on the opening/closing rope is equal to or less than the predetermined value; and
a cylinder contraction device configured to contract the slack adjustment cylinder when the raising/lowering operation tool is operated to a raising side to raise the clamshell bucket.

2. The deep foundation excavator according to claim 1,
wherein the cylinder contraction device includes a throttle for restricting a contraction speed of the slack adjustment cylinder.

3. The deep foundation excavator according to claim 1,
wherein the cylinder contraction device includes:
a discharge liquid line for connection between a bottom-side oil chamber in the slack adjustment cylinder and a hydraulic oil tank; and
a pilot operation check valve that is disposed in the discharge liquid line and allows hydraulic oil in the bottom-side oil chamber to flow toward the hydraulic oil tank when the raising/lowering operation tool is operated to the raising side to raise the clamshell bucket.

4. The deep foundation excavator according to claim 1,
wherein the cylinder contraction device includes:
a forced switch pilot line configured to switch a slack removal switching valve so that hydraulic oil is supplied to a rod-side oil chamber in the slack adjustment cylinder when the raising/lowering operation tool is operated to the raising side to raise the clamshell bucket.

5. The deep foundation excavator according to claim 1,
wherein the raising/lowering cylinder, the opening/closing cylinder and the slack adjustment cylinder each are arranged along a longitudinal direction of the arm.

* * * * *